US011178980B2

(12) United States Patent
Pongrac et al.

(10) Patent No.: US 11,178,980 B2
(45) Date of Patent: Nov. 23, 2021

(54) RETAIL DEVICE

(71) Applicants: Ivan Pongrac, Cranbourne (AU); John Pongrac, Cranbourne (AU); Chris Pongrac, Cranbourne (AU)

(72) Inventors: Ivan Pongrac, Cranbourne (AU); John Pongrac, Cranbourne (AU); Chris Pongrac, Cranbourne (AU)

( * ) Notice: Subject to any disclaimer, the term of this patent is extended or adjusted under 35 U.S.C. 154(b) by 0 days.

(21) Appl. No.: 16/615,022

(22) PCT Filed: May 21, 2018

(86) PCT No.: PCT/AU2018/000074
§ 371 (c)(1),
(2) Date: Nov. 19, 2019

(87) PCT Pub. No.: WO2018/209379
PCT Pub. Date: Nov. 22, 2018

(65) Prior Publication Data

US 2020/0085210 A1 Mar. 19, 2020

(30) Foreign Application Priority Data

May 19, 2017 (AU) ..... 2017901903

(51) Int. Cl.
*A47F 1/12* (2006.01)

(52) U.S. Cl.
CPC ..... *A47F 1/128* (2013.01); *A47F 1/126* (2013.01)

(58) Field of Classification Search
CPC ..... A47F 1/126; A47F 1/128; A47F 5/0006
See application file for complete search history.

(56) References Cited

U.S. PATENT DOCUMENTS 1,587,936 A * 6/1926 Brunhoff ..... A47F 1/126 211/51
2,423,788 A * 7/1947 Muller-Molnar ..... A47F 1/126 221/232

(Continued)

FOREIGN PATENT DOCUMENTS

DE 102012020532 A1 * 4/2014 ..... A47F 1/126
EP 1302136 A1 * 4/2003 ..... A47F 1/128

(Continued)

OTHER PUBLICATIONS

PCT International Search Report and Written Opinion, International Application No. PCT/AU2018/000074, Jason Barrido, Authorised Officer, Australian Patent Office, dated Jul. 30, 2018, 7 pgs.

*Primary Examiner* — Stanton L Krycinski
(74) *Attorney, Agent, or Firm* — Patent Law Works, LLP

(57) ABSTRACT

A retail display device (10) comprises a carriage (40) mounted to a retail hook rail (20) adapted to be cantileveredly supported by a support structure (2). The carriage (40) comprises a pair of hingedly attached arms (41, 42), including a first arm (41) adapted to slide along the hook rail (20) and a second arm 42 adapted to reciprocate along the hook rail (20). The pair of arms (41, 42) are biased to pivot apart, such that the first arm (41) tends to assume an inclined position relative to the hook rail (20) and the first arm (41) is adapted to be drawn towards an upper portion (47) of the second arm by a gathering device (60) extending between the respective first and second arms (41, 42). The gathering device is flexible and extends forward beyond the second arm (42) to a lever (88) mounted to the front of the hook (20).

19 Claims, 20 Drawing Sheets

(56) References Cited

U.S. PATENT DOCUMENTS

| | | | | | |
|---|---|---|---|---|---|
| 2,732,952 | A | | 1/1956 | Skelton | |
| 5,641,077 | A | * | 6/1997 | Tufano | A47F 1/128 211/54.1 |
| 5,906,283 | A | | 5/1999 | Kump et al. | |
| 5,988,407 | A | * | 11/1999 | Battaglia | A47F 1/126 211/51 |
| 6,015,051 | A | * | 1/2000 | Battaglia | A47F 1/126 211/51 |
| 6,082,558 | A | * | 7/2000 | Battaglia | A47F 1/126 211/51 |
| 6,102,192 | A | * | 8/2000 | Tomuro | A47F 1/128 198/747 |
| 6,131,748 | A | * | 10/2000 | Kawasaki | A47F 1/128 211/54.1 |
| 6,889,855 | B2 | * | 5/2005 | Nagel | A47F 1/126 211/59.3 |
| 7,566,037 | B2 | * | 7/2009 | Vogler | A47F 1/128 211/54.1 |
| 7,708,154 | B2 | * | 5/2010 | Lang | A47F 1/126 211/59.3 |
| 8,739,980 | B2 | * | 6/2014 | Valiulis | A47F 1/128 211/54.1 |
| 9,386,864 | B2 | * | 7/2016 | Pongrac | A47F 5/0869 |
| 2004/0178157 | A1 | * | 9/2004 | Tse | A47F 1/126 211/59.3 |
| 2005/0167375 | A1 | * | 8/2005 | Pagano | A47F 1/128 211/54.1 |
| 2007/0108142 | A1 | * | 5/2007 | Medcalf | A47F 1/126 211/59.3 |
| 2010/0108624 | A1 | * | 5/2010 | Sparkowski | A47F 3/147 211/59.3 |
| 2012/0211450 | A1 | | 8/2012 | Kologe | |

FOREIGN PATENT DOCUMENTS

| | | | | | |
|---|---|---|---|---|---|
| EP | 2724954 | A1 | | 4/2014 | |
| FR | 2775570 | A1 | * | 9/1999 | A47F 5/0869 |
| JP | 09065956 | A | * | 3/1997 | A47F 1/128 |
| JP | 09224789 | A | * | 9/1997 | A47F 1/128 |
| JP | 10033320 | A | * | 2/1998 | A47F 1/128 |

* cited by examiner 4a
64
80
63
61
62b
62c
40
41
51b
49b
51a
67a
62a
66
30

62d
4a
64
80
63
62a
40
62c
62d
62b
30

Figure 25
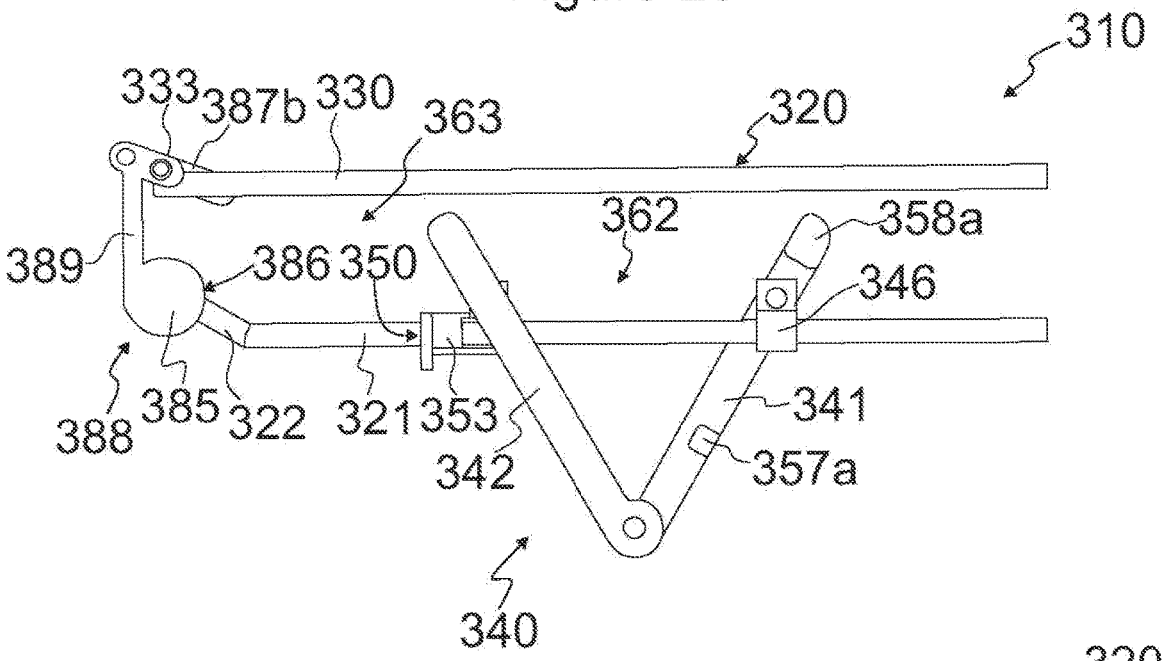
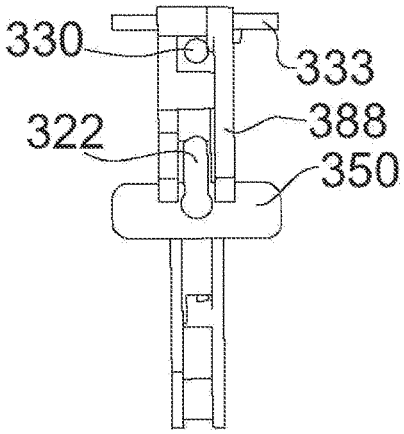
Figure 26
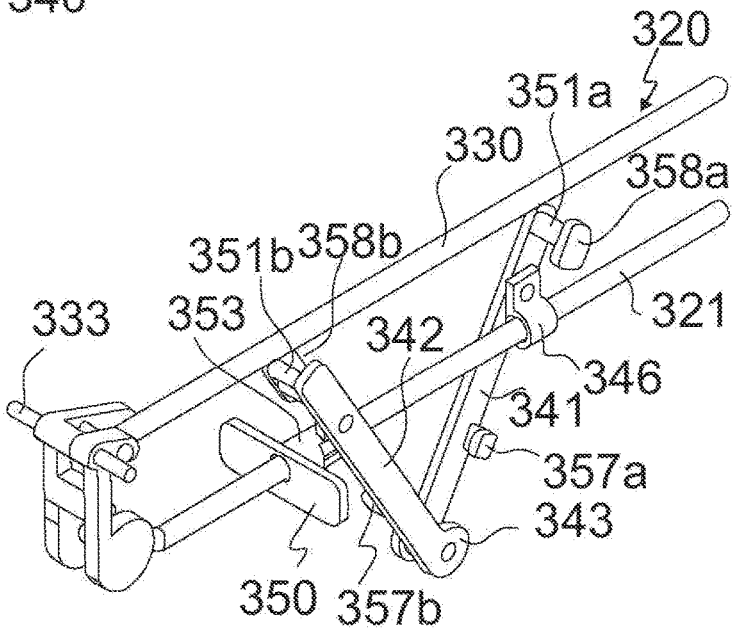
Figure 27

RETAIL DEVICE

FIELD OF INVENTION

This invention relates to a retail device. More particularly, this invention relates to a retail item feed device in the form of a hook, rail and carriage device.

BACKGROUND ART

The following references to and descriptions of prior proposals or products are not intended to be, and are not to be construed as, statements or admissions of common general knowledge in the art. In particular, the following prior art discussion should not be assumed to relate to what is commonly or well known by the person skilled in the art, but to assist in the inventive process undertaken by the inventor(s) and in the understanding of the invention.

Current retail hook devices for displaying multiple items of the same product, for example packages of toothbrushes, packaged sweets and other high volume perishable and single-use items are known to have a hook rail with an upturned terminal end to retain the packaged products on the rail. A front panel, optionally pivotable, may be provided at the front end of the rail, typically on an upper rod extending parallel to the hook rail. Various unsuccessful attempts have been made by traders of the years to provide spring devices that urge product forward as front-positioned packages are removed by shoppers, so that a front-most package is always presented at the very end of the rail. However, the force supplied by such spring-biased devices is invariably either too small to urge product forward or too great, such that product bunches at the front of the rail. Easy mounting of packaged products onto the rail is not possible with the constant spring force urged product back towards the front of the rail.

An object of the present invention is to ameliorate the aforementioned disadvantages of the prior art or to at least provide a useful alternative thereto.

STATEMENT OF INVENTION

The invention according to one or more aspects is as defined in the independent claims. Some optional and/or preferred features of the invention are defined in the dependent claims.

Accordingly, in one aspect of the invention there is provided:

A retail display device comprising:

a carriage mounted to a retail hook rail adapted to be cantileveredly supported by a support structure, the carriage comprising a pair of hingedly attached arms including:

a first arm adapted to slide along the hook rail, and a second arm adapted to reciprocate along the hook rail, the pair of arms biased to pivot apart, such that the first arm tends to assume an inclined position relative to the hook rail and the first arm is adapted to be drawn towards an upper portion of the second arm by a gathering device extending between the respective first and second arms, the gathering device being flexible extending forward beyond the second arm to a lever mounted to the front of the hook.

In another aspect of the invention there is provided:

A retail display device comprising a carriage mounted to a retail hook rail having a pair of substantially horizontally extending rods adapted to the cantileveredly supported by a support structure, the carriage comprising a pair of opposed arms adapted to slide along the hook rail and movable relative to each other to vary the spacing therebetween, the pair of arms including first and second arms adapted to reciprocally travel along the hook rail, the pair of arms biased to spread apart, such that the first and second arm assume are most widely spaced when the carriage is disposed at its most frontward extent near a lever mounted near or at the front of the hook rail, and the pair of arms adapted to be drawn together by a gathering device extending between the respective arms, the gathering device extending beyond the second arm to the lever.

In still another aspect of the invention there is provided:

A retail display device comprising a carriage mounted to a retail hook rail having a pair of substantially horizontally extending rods adapted to the cantileveredly supported by a support structure, the carriage comprising a pair of hingedly attached arms, including a first arm adapted to slide along the hook rail and pivotal between an inclined orientation relative to the hook rail and a vertical orientation relative to the hook rail, and a second arm adapted to reciprocate along the hook rail, the pair of arms biased to pivot apart, such that the first arm tends to assume an inclined position and the arms are adapted to be drawn together towards a respectively parallel orientation by a gathering device extending between the respective arms, the gathering device extending beyond the second arm to a lever mounted to the front of the hook rail.

The second arm may be mounted to the hook rail by an axial guide. The axial guide may be hingedly attached by a second hinge to a beam of the second arm intermediate its length. The axial guide may include a broad barrier or bumper extending forward of the beam and adapted to urge a rearmost item mounted on the hook rail frontward. The first arm may be hingedly attached by a first hinge to the hook rail by a first axial guide. The first axial guide may be laterally spaced from a longitudinal axis of the hook rail a first fixed distance. The second hinge may be laterally spaced from the longitudinal axis a second fixed distance. The gathering device may include a scissor mechanism in which the first and second arms are adapted to incrementally advance along the hook rail in response to the rotation of a lever to which the gathering device is attached. The gathering device may be linked to the lever by a pair of linkages. A front one of the linkages may be inclined downwardly and rearwardly relative to a lever arm depending downwardly from a hinge connection between the lever and the hook rail. The lever arm may terminate at its lower portion in a rearwardly extending striker member. The lever may be crotchet-shaped in side view and the striker member may present a curved ramp or cam surface to the frontmost item.

The gathering device maybe a suitable device adapted to accommodate a range of spacings between the first and second arms whilst permitting the bias to apply a substantially constant force towards the front of the hook rail through a front face of the second arm. The gathering device may include a motorized spring or screw device, a solenoid or small ram. Or the gathering device may comprise a length of cord, rope, web, ribbon or flexible wire looped between the first and second arms.

The cord is preferably a single length looped between the first and second arms, such that there is at least two lengths of the cord extending in parallel between the respective arms. The cord preferably extends between the pair of arms at a position on each arm that is remote from the hinge. Desirably, at least three sections of the cord extend between the pair of arms. The effect is that as the carriage approaches the front of the rail hook, the length of the cord is gathered between the respective arms. The arms increasingly part by relative rotation about their hinge connection, so that the angle between each arm increases as the carriage approaches the front of the rail hook.

As packaging items are loaded onto the rail hook, the second arm is urged rearwardly, the angle between the respective arms closes to a smaller angle, the length of cord extending between the lever and the second arm increases as the sum of the length of the cord (extending between the respective arms as loops) diminishes.

For example, if there are three sections of the cord extending between the first and second arms, then the increase in the length of cord between the second arm and the lever is a multiple of three compared to the reduction of the spacing between the pair of arms taken at the points intermediate the length of the respective arms where the cord is either attached or extends to or from. As the carriage moves frontwards, the length of cord extending between the second arm and the lever reduces and that length of cord is gathered in the loops of cord extending between the respective arms.

The bias device may be a spring. The spring may be a compression spring extending between the respective arms, for example, intermediate the length of each of the arms. Alternatively, the bias may be a torsion spring. The torsion spring may be coaxial with the hinge. The torsion spring may include a pair of arms, each arm varying outwardly against an inner wall of the first or second arm.

The first arm may include a central substantially vertical slot adapted to receive the rail hook and capable of accommodating the second arm at a range of different inclinations relative to the rail hook.

The second arm may include a rail hook guide adapted to maintain the substantially vertical orientation of the second arm relative to the rail hook. The second arm may extend up to and around the upper rod and it may include a slot or recess in which the upper rod is received. The lever is preferably pivoted to a lateral hinge pin extending traverse to the upper rod at its front most end. The lever may be adapted to pivot such that it is displaced as a package item is loaded on to the rail hook without imposing force on the gathering device. However, the lever is preferably adapted to impose a drawing (frontwardly) force on the gathering device as the front most packages are removed from the rail hook.

The lever may be adapted to pivot away from the rail hook on removal of a packaged item and may have a detent fixed to rotate with the lever that bears transversely onto the cord to pull the carriage frontwardly. The effect of moving the carriage frontwardly reduces the length of cord extending the carriage and the lever and the tension in the cord is restored by the gathering device as the bias urges the pair of arms apart and the excess length of cord is taken up in the loops extending between the pair of arms.

The lever may connect to the gathering device by an intermediate link comprising a pair of pivotably connected links. A front most link may be pivotably mounted to the upper rod hinge and an intermediate link may connect the linkage to a terminal end of the gathering device.

The lever may include a front surface. The front surface may be adapted to deflect on being pressed against, for example by a packaged item to be loaded onto the hook.

The front surface may present a broad surface to be borne against, struck or nudged to shift to a first open position. In the first open position, the lever may be moved rearwardly out of the way to enable an item to be loaded onto the hook.

The lever may include at least one lever arm. The at least one lever arm may include a pair of lever arms. The lever arm may be hingedly mounted to an upper rod of the hook rail. The lever arm may depend from a hinge and be adapted to pivot about the hinge. The pair of lever arms may be spaced. The pair of lever arms may be spaced laterally relative to the longitudinal axis of the hook rail. The pair of lever arms may be connected intermediate their lengths by a lateral bar. The lever may be H-shaped with the pair of lever arms hanging from the hinge. The free end of a lower rod of the hook rail may intersect a lateral and substantially vertical plane in which the pair of spaced lever arms hang at rest.

The lever arm may include a rear surface. The rear surface may be adapted to be borne against, struck or nudged to shift to a second open position. In the second open position, the lever arm may be moved forwardly by the removal of an item from the hook rail. By the rear surface being borne against, struck or nudged to shift to an open position, the lever arm may be swung out of the way to enable the item to be removed from the hook rail.

The front and the rear surfaces may be axially spaced relative to the longitudinal axis of the hook rail. The spacing of the front and rear surfaces may be of the order of the axial width of an item to be displayed on the device. The spacing of the front and rear surfaces may be of the order of between about 40-100% of the length of a terminal upturned hook of the hook rail. The spacing of the front and rear surfaces may be between about 10-30 mm.

The lever may include one or more striker members rearwardly of the lever and make physical contact with the front most packaged item. As a packaged item is removed from the rail hook, the striker urges the lever away from the rail hook to clear the way for the packaged item to be removed, where upon the lever draws on the gathering device and the carriage is crept forward by the distance formally occupied by the previously front most packaged item.

The striker member may be convexly smooth in shape whereby to present a smooth surface to be borne, struck or nudged against the item. The striker member may be substantially round, oval, circular-shaped, or otherwise cammed to reduce the potential for snagging of items against the striker member. The one or more striker members may include a pair of striker members. The pair of striker members may be laterally spaced relative to the longitudinal axis of the hook rail. The lever may straddle the terminal end of the hook rail. The pair of striker members may include a first striker than is laterally narrower than a second striker. The second striker may present a broader front surface than the first striker. The second striker may present a broader rear surface than the first striker.

The front surface may substantially lie in a front plane oriented at rest that is substantially vertical and lateral relative to the longitudinal axis of the hook rail. The front plane may be closely adjacent and parallel to a vertical plane in which the axis of the lever hinge lies. At rest, the rear surface may intersect a substantially vertical rear plane aligned transverse relative to the longitudinal axis of the hook rail. The rear plane is preferably axially spaced rearwardly from the front plane.

BRIEF DESCRIPTION OF THE DRAWINGS

The invention may be better understood from the following non-limiting description of preferred embodiments, in which:

FIG. 25 is an opposite side of the hook device shown in FIG. 24;

FIG. 26 is a front end view of the hook device shown in FIG. 24; and

FIG. 27 is a perspective of the hook device shown in FIG. 24, noting that the web of the gathering device 360 is not shown in FIGS. 25-27 for the sake of clarity.

DETAILED DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention.

Figure 1:
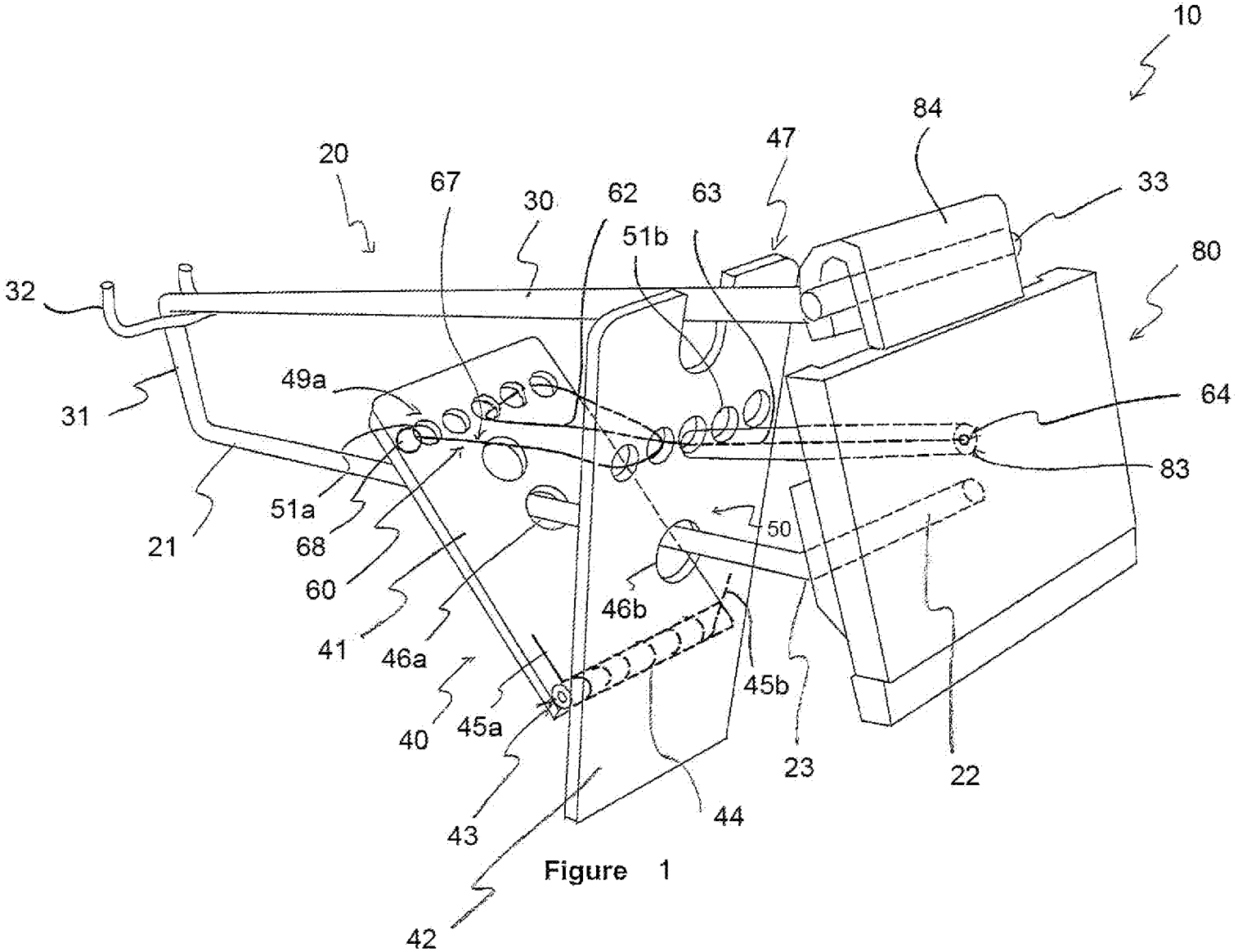
FIG. 1 is a perspective view of a retail hook device according to a first embodiment.
Figure 3:
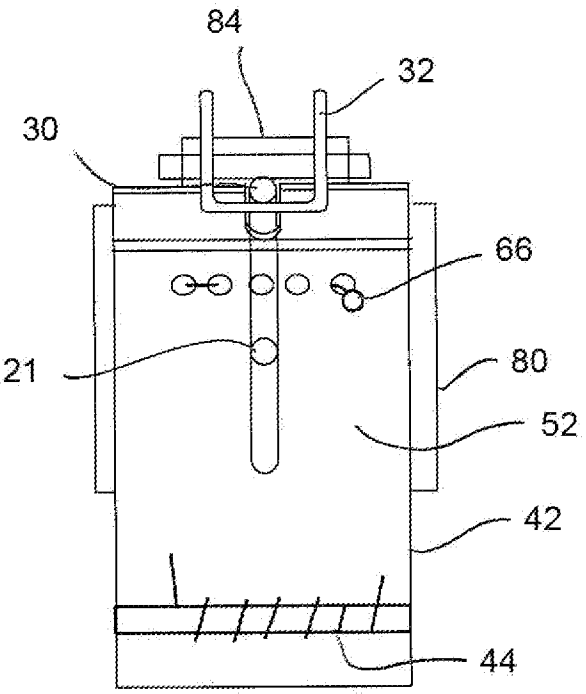
FIG. 3 is a schematic rear sectional view of the embodiment shown in FIG. 1.
Figure 2:
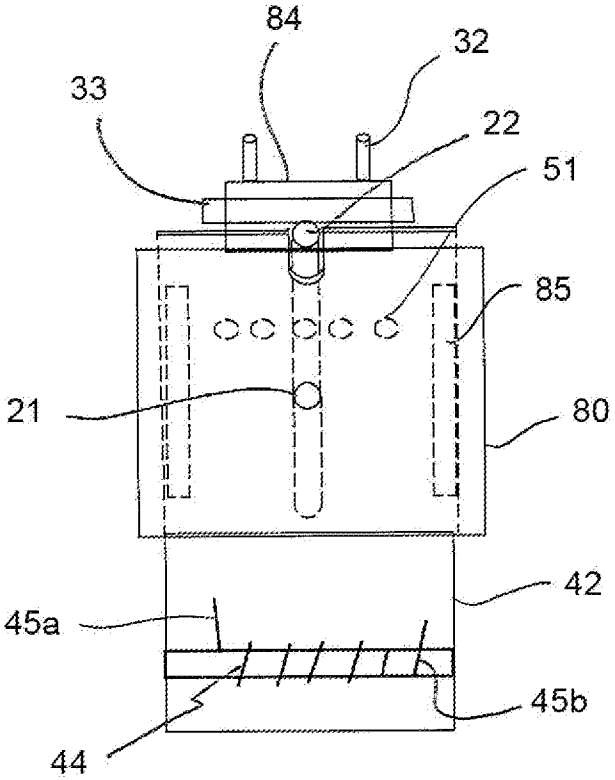
FIG. 2 is a schematic front sectional view of the embodiment shown in FIG. 1.

Referring to FIG. 1 it is shown a first embodiment in the form of a retail hook device 10 comprising a retail hook rail 20, a carriage 40, a gathering device 60 and a display device 80.

The retail hook device 10 comprises the carriage 40 mounted to a retail hook rail 20 adapted to be cantileveredly supported by a support structure 2. The carriage 40 comprises a pair of hingedly attached first and second arms 41, 42, including a first arm 41 adapted to slide along the retail hook rail 20 and a second arm 42 adapted to reciprocate along the retail hook rail 20. The pair of first and second arms 41, 42 are biased to pivot apart, such that the first arm 41 tends to assume an inclined position relative to the retail hook rail 20 and the first arm 41 is adapted to be drawn towards an upper portion 47 of the second arm by a gathering device 60 extending between the respective first and second arms 41, 42. The gathering device 60 is flexible and extends forward beyond the second arm 42 to a lever 80 mounted to the front of the retail hook rail 20.

Figure 4:
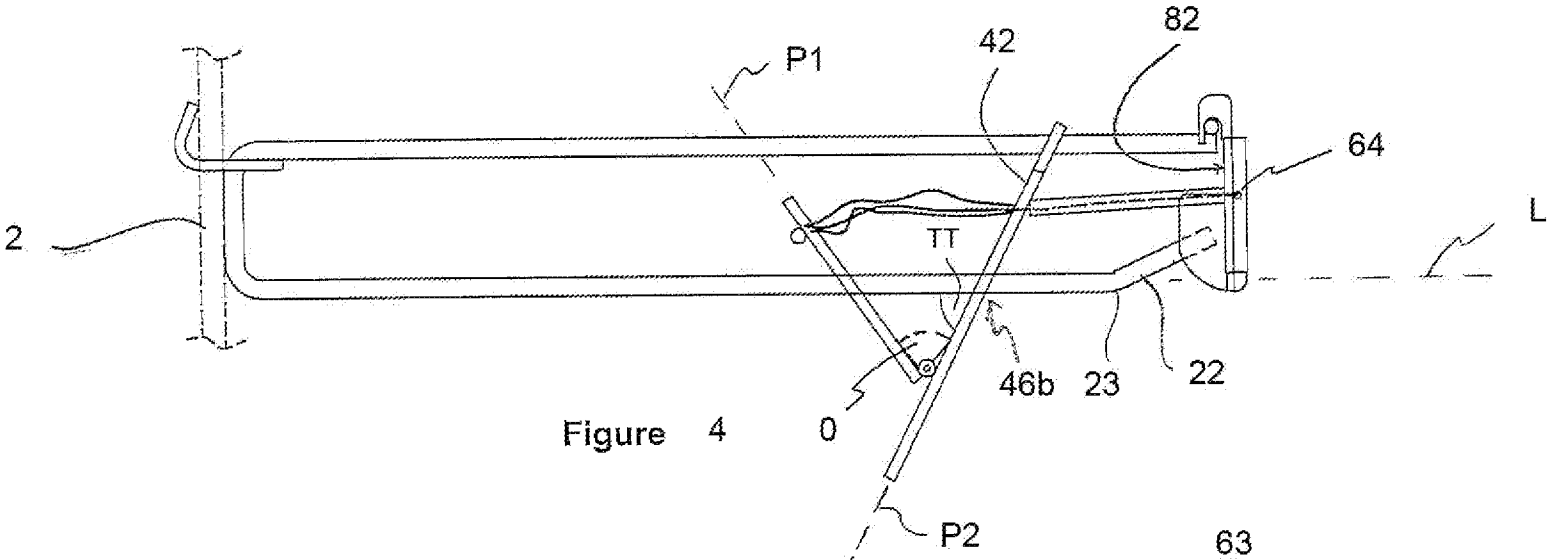
FIG. 4 is a side view of the embodiment shown in FIG. 1.

The retail hook rail 20 comprises a pair of generally laterally extending and substantially parallel lower and upper rods 21, 30. The lower most rod 21 may be connected to the upper most rod 30 by a substantially vertically aligned end bridge member 31, whereby the upper rod 30 is adapted in use to extend immediately above the lower rod 21 and be substantially co-terminal therewith. A single curved and U-shaped holding member 32 is welded to the rear most portion of the upper rod 30 and may be used to hook into complementary recesses or slots in a support structure 2 as depicted in FIG. 4. The upper rod 30 terminates in a lateral hinge bar 33 forming a T across the front terminal end of the upper rod 30. The lower rod 21 includes an upturned hook portion 22 shown in ghosted outline in FIG. 1 formed by an upward bend 23 in the lower rod near the front most terminal end thereof. In general terms, the retail hook rail 20 is similar to prior art devices.

Figure 6A:
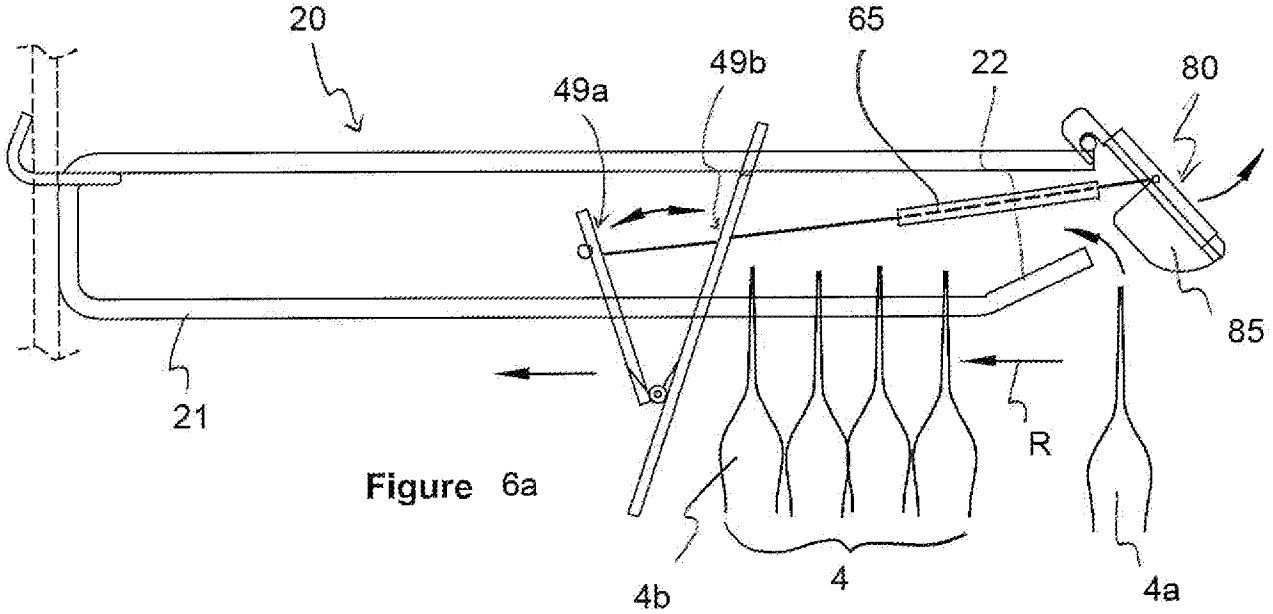
FIGS. 6*a* and 6*b* are side views of the embodiment shown in FIGS. 1 and 4 showing the retail hook device mechanism during loading of display items.
Figure 6B:
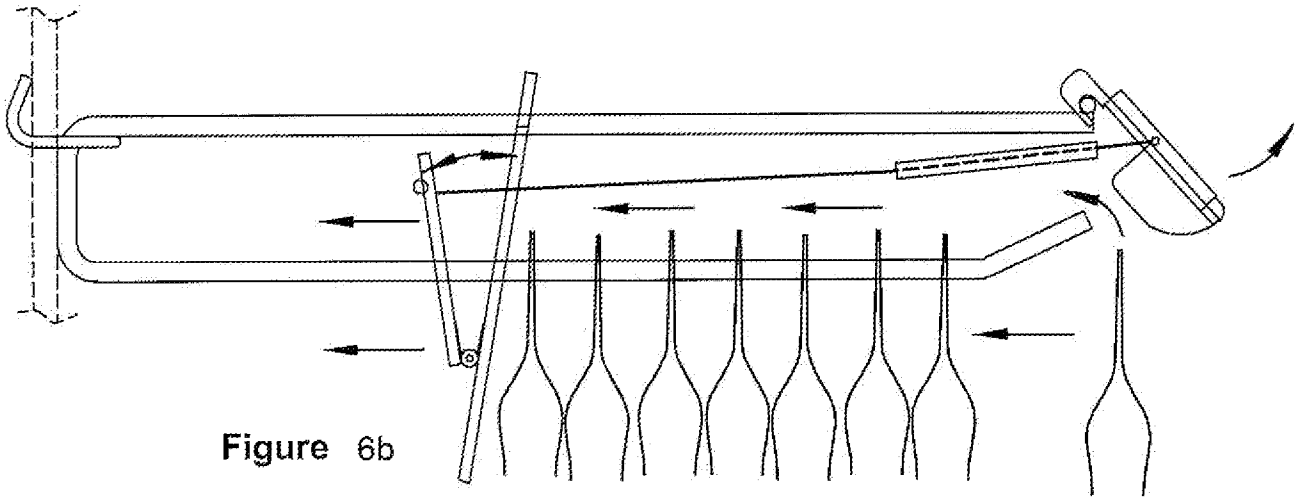
Figure 7:
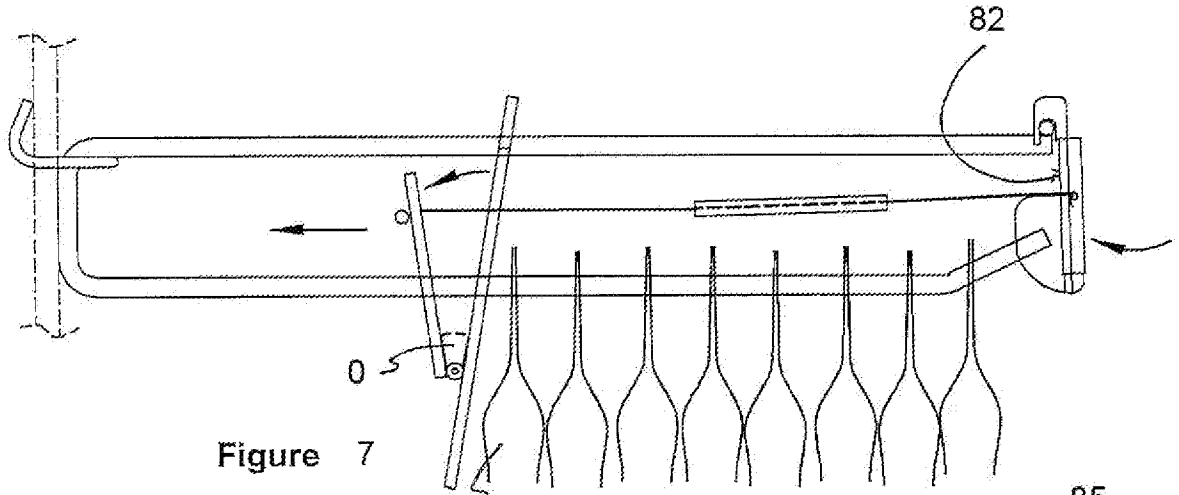
FIG. 7 is a side view of the embodiment shown in FIG. 1 in which display items are loaded on the retail hook device.

The carriage 40 includes a first arm 41 pivotal about a hinge 43 mounted to a second arm 42. The hinge 43 is biased by a torsion spring 44 mounted co-axially about the hinge 43 and having first and second ends 45*a, b* that are adapted to urge the first and second arms 41, 42 apart. The first and second arms 41, 42 are mounted to the lower rod 21 by providing central apertures 46*a, b*, respectively, in each of the first and second arms 41, 42, whereby to receive the lower rod 21 therethrough. The central aperture 46*b* in the second arm 42 is typically a close fit with the diameter of the aperture 46*b* being only slightly larger than the diameter of the lower rod 21. The second arm 22 includes at its upper end 47 a central open slot 48. The slot 48 is upwardly open to form a saddle through which the upper rod 30 extends. The engagement of the slot 48 with the upper rod 30 provides a guide for the second arm 42 to remain substantially vertical as the carriage 40 reciprocally travels along the length of the upper rod 30. The diameter of the second aperture 46*b* may be sufficient to permit the second arm 42 to align in a plane $P_2$, which, as shown in FIG. 4. The second arm 42 can assume an angle 7E relative to the lower rod 21 of between 50-90°, and preferably a range of between 60-90°. The apertures 46*a, b* may be ovaloid or slot-like in shape and such that they are elongate along a virtual vertical axis, thereby operating as slot apertures. Similarly, the first arm 41 may lie in a plane $P_1$ such that the first arm 41, relative to the substantially horizontal lower rod 21, is set at angle that is substantially 50-90° relative to the general longitudinal axis L of the lower rod 21. As the gathering device 60 draws the first and second arms 41, 42 towards each other against the bias of the spring 44, the angle theta between the first and second arms 41, 42 from the hinge 43 diminishes progressively, as indicated in FIGS. 6*a*-7, such that, at the rearmost extent of the position of the carriage 40 along the length of the retail hook rail 20, the angle theta approaches zero.

The first and second arms 41, 42 comprise substantially planar panels, preferably made of a low friction plastic material, such as acrylic or nylon 66, to reduce friction between the aperture 46*a,b* walls and the lower rod 21, on the one hand, and the gathering device 60, on the other hand.

The gathering device 60 comprises a flexible length of high tensile material. The gathering device 60 may be string, wire or cord 61, preferably made of a high tensile, flexible length of woven, linked or extruded material. Preferably, the cord 61 is made of nylon 66. For this purpose, heavy gauge fishing line, such as 15-50 pound fishing line, may be suitable, with lighter gauge line 61 being suitable for low mass display items such as toothbrush packets, and heavier gauge line 61 for packets of nails, screws, staples and the like. The cord 61 is looped between the first and second arms 41,42 to provide at least two lengths of cord 61 extending between the first and second arms 41,42. Preferably, a third length of cord 61 is provided between the first and second arms 41,42 to provide a 3× multiplication effect between the length of cord 63 extending between the second arm 42 and the display device acting as the lever 80. Therefore, as the carriage 40 moves from a frontward position as shown in FIG. 5 to a rearward position shown in FIG. 7, the change in the length 63 of the cord 61 will be a multiple of the change in spacing between the first and second arms 41,42 at the opposed faces 49*a, b* of the respective first and second arms 41, 42 at the location where the cord 61 extends there between (reference 62*a*).

It is noted that the torsion spring 44 imposes a small force to affect the spreading of the first and second arms 41, 42 relative to each other, so that the loops 62 of cord extending between the first and second arms 41, 42 is generally held under light tension forces. However, when the second arm 42 is first pushed rearwardly by a display item 4 pushing against a frontward face 49*c* of the second arm 42, the loops 62 may initially slacken and or bunch momentarily until the effect of the bias of the torsion spring 40 urges the first and second arms 41, 42 away from each other until the balancing of the bias 44 and full tension of the cord 61 achieves equilibrium, as shown in FIG. 7. The front most 64 end of the length of cord 61 is anchored to the display device acting as the lever 80 and extends through a series of apertures 51 formed in the first and second arms 41, 42 at the level of the opposed faces 49*a, b*.

The display device 80 is useful to display a description of the items 4 to be mounted on the retail hook rail 20 and has a front board panel 81 for this purpose. The display device also acts as the lever 80 to which the terminal end 64 of the cord 61 is attached by providing a small anchoring bead 64 that may be trapped in a recess and slot feature 83 on the upper side of the display device 80. The initial front most length of cord 61 is sheathed in a sleeve 65 that is advantageously a plastic tube of, for example, PVC, that is substantially axially non-compressible in the context of the low torsional forces imposed by the bias spring 44, whereby to limit the frontward extent of travel of the carriage 40. The sleeve 65 may be free to axially float along the front length 63 of the cord 61 when not compressed end-on-end.

Figure 5:
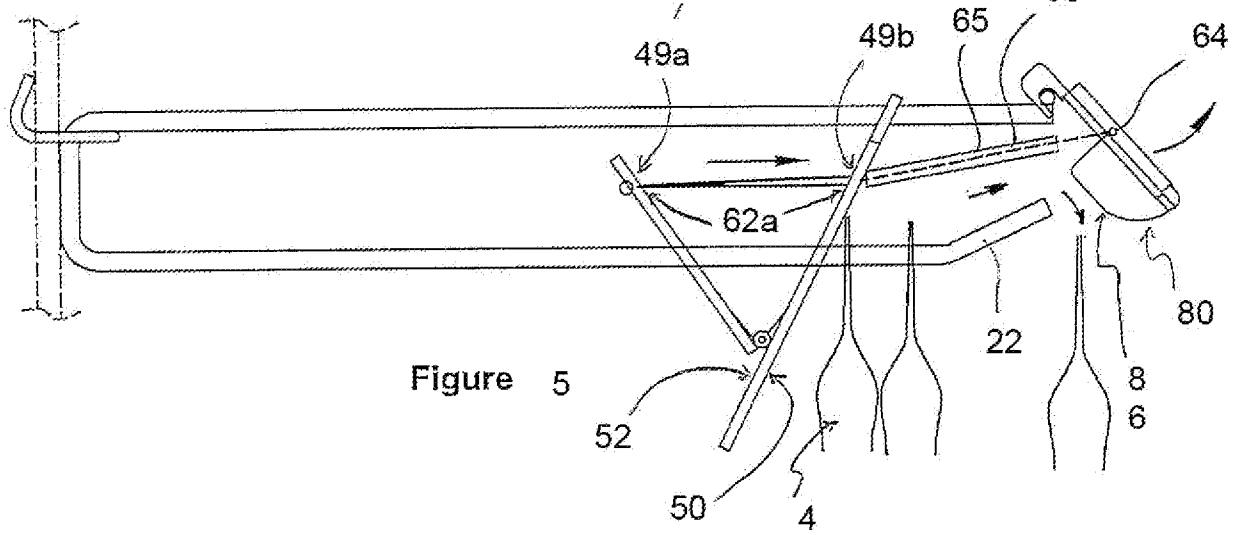
FIG. 5 is a schematic side view of the embodiment shown in FIG. 4 in which display items are removed.
Figure 8:
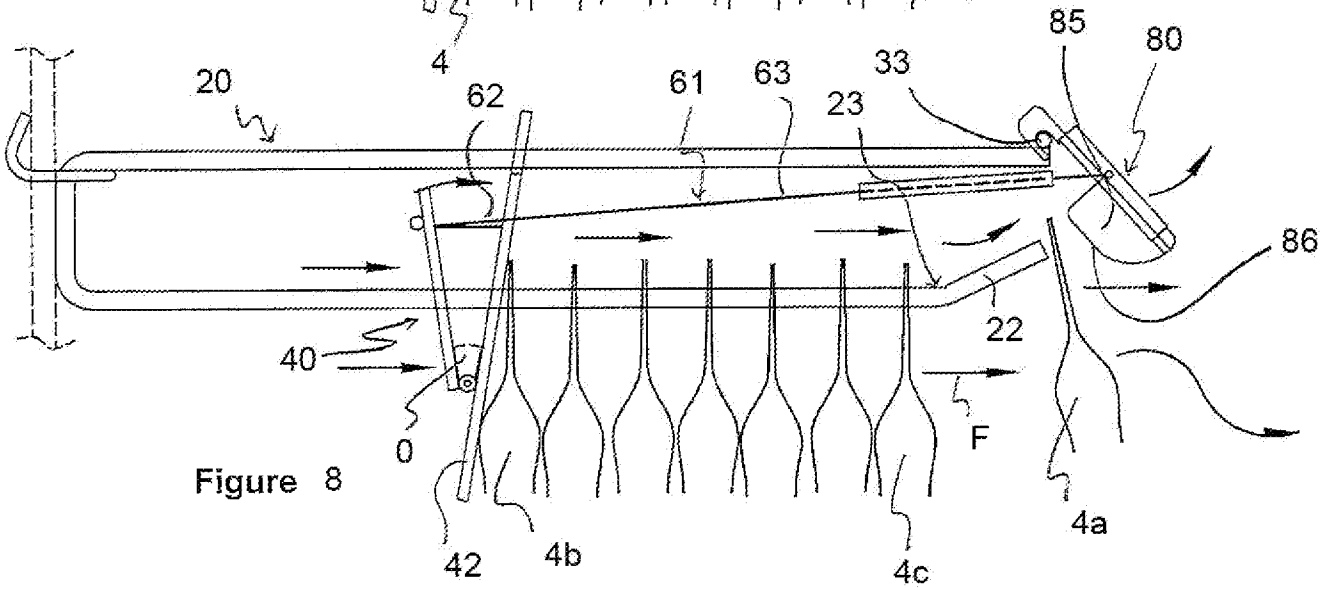
FIG. 8 is a side schematic view illustrating the removal of display items from the retail hook device shown in FIG. 1.
Figure 9:
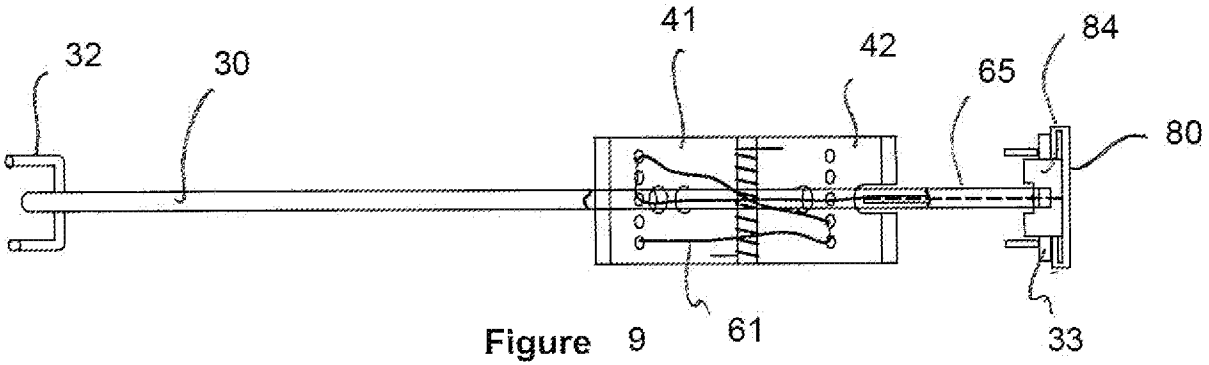
FIG. 9 is a top plan view of the embodiment as represented in FIG. 4.
Figure 10:
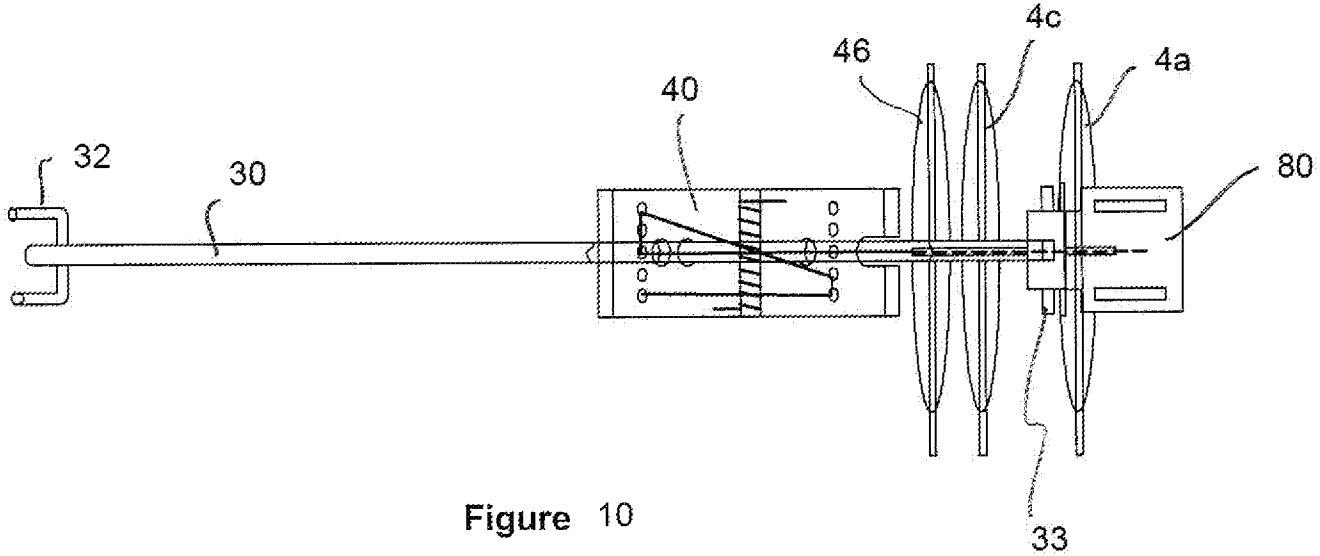
FIG. 10 is a top plan view of the embodiment as represented in FIG. 5.

The display device 80 is pivotally mounted. it includes a U-shaped hinge bracket 84 to the lateral hinge 33 and is adapted swing outwardly as depicted in FIG. 5. The reverse side 82 of the display device 80 comprises one or more striker members 85 that have a rear most edge 86 adapted to provide correct spacing between a front most item 4*a* to be removed as shown in FIG. 8.

In operation, a user wishing to release an item 4*a* from the retail hook rail 20 may grasp the item 4*a* and draw it frontwardly off the upturned hook portion 22, so that the item 4*a* abuts the rear most edge 86 and urges it to move forwardly and clear of the terminal front end of the upturned hook portion 22 to enable the item 4*a* to be removed. Accordingly, the lever 80 may move upwardly as depicted in FIG. 8. As the lever 80 rotates upwardly about the hinge 84 and the hinge bar 33, tension is applied to the cord 61 by urging the terminal end 66 forward. As the cord 61 extends from the section 63 through the apertures 51 of the second arm 42 and around apertures 51*a* in the first arm 41, the loops 62 are shortened to draw the first and second arms 41, 42 toward each other and the carriage 40 is urged to creep, or make an incremental movement, forward, thereby abutting against the rearmost item 4*b*, so that the newly front most item 4*c* is urged forward in the direction F to assume a position on or about the bend 23. Equilibrium between the forces of the tension of the cord 61 and the torsional forces of the spring bias 44 is attained, so that the angle theta is slightly increased as the carriage 40 moves frontwardly to take up the length of cord 63 lost between the second arm 42 and the lever 80 in the lengths of loop 62 between first and second arms 41, 42.

As shown in FIG. 6*a*, to load an item 4*a* onto the retail hook rail 20, an operator may lift the lever 80 to clear the striker members 85 away from the upturned hook portion 22 to clear the way for the item 4*a* to be loaded onto the lower rod 21. The operator forces the series of items for rearwardly in the direction ark whereby to urge the rearmost item 4*b* against the front face 50 once again close the angle theta, i.e. to shorten the spacing between the first and second arms 41, 42 at the level of the opposed faces 49*a*, 49*b*. The effect is to lengthen the length of cord 61 in the section 63 by reducing the length of looped cord 62 from between the opposed faces 49*a, b*.

Figures 11, 12:
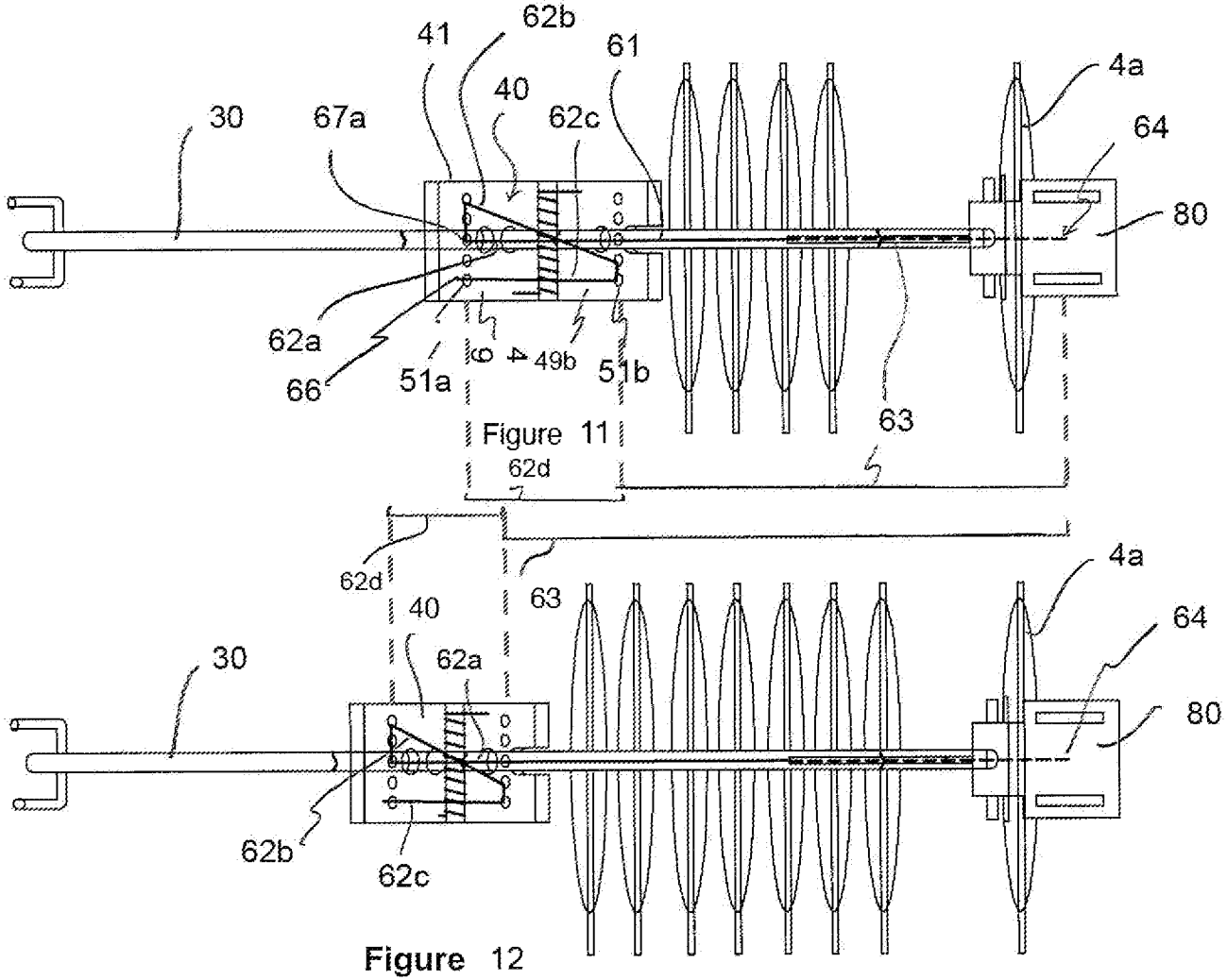
FIG. 11 is a top plan view of the embodiment as represented in FIG. 6*a;*
FIG. 12 is a top plan view of the embodiment as represented in FIG. 6*b;*
Figure 13:
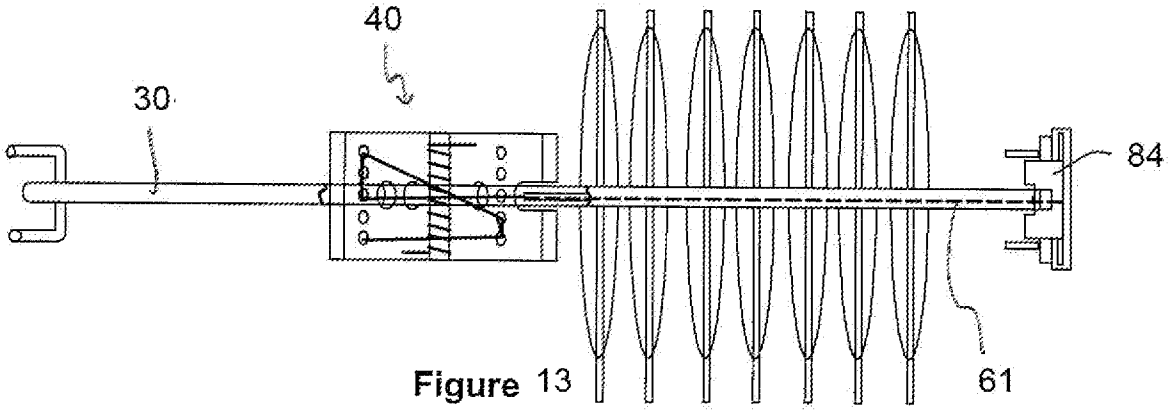
FIG. 13 is a top plan view of the display hook device according to the embodiment shown in FIG. 1 wherein seven items are loaded.
Figure 14:
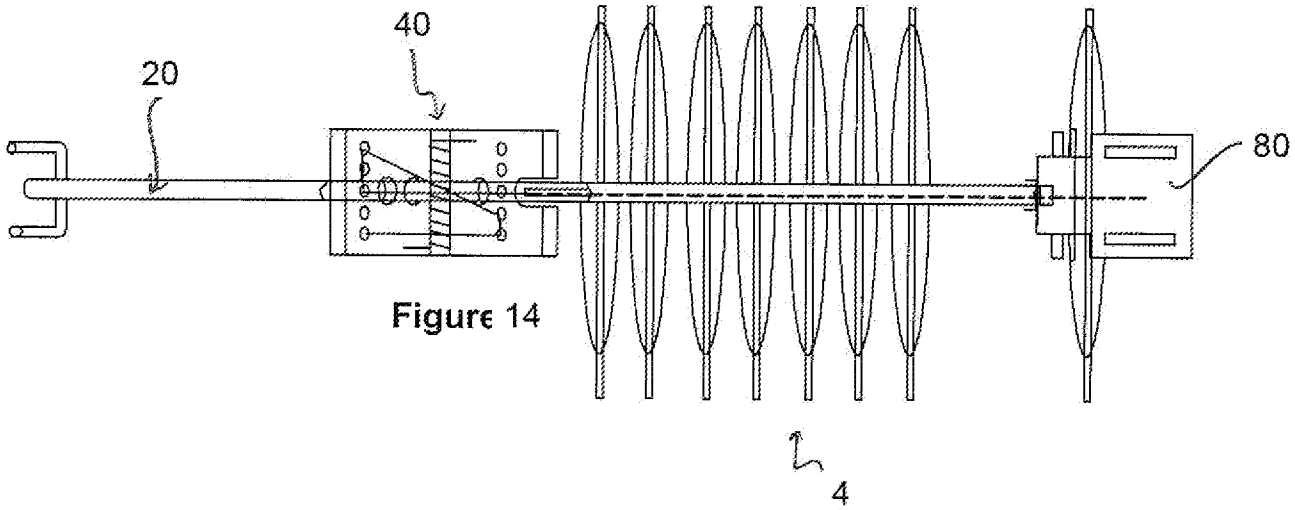
FIG. 14 is a top plan view of the embodiment shown in FIG. 8.

As depicted in FIGS. 11 and 12, the looped section 63 comprises three passes of length of cord 61, including a first pass 62*a* in which the length of cord 61 extends uninterrupted from its front most terminal end 64 through to a first bend 67*a* as the cord 61 extends through central apertures of the series of apertures 51*a, b*, around a rear face 52 of the first arm 41, back through an outer aperture of the series of apertures 51*a* forming a length 62*b* extending between the opposed faces 49*a, b*, through an aperture in the series of apertures 51*b* and around the front face 50 of the second arm 42 and back through an outer aperture of the series of apertures 51*b* to form a third pass 62*c* extending between the opposed faces 49*a, b*, and terminating at a rear most terminal end 66 where a terminal bead anchors the terminal end 66 on the rear face 52 of the first arm 41. It can be seen by comparing FIGS. 11 and 12 that the length 62 increases by a multiple of the change to the space separating the first and second arms 41, 42 at the level 49*a, b* of the apertures 51*a, b* (reference 62*d*). As the skilled person can appreciate, such multiplication factors are approximate, particularly in light of diagonal passes, such as length 62*b*.

Figure 15:
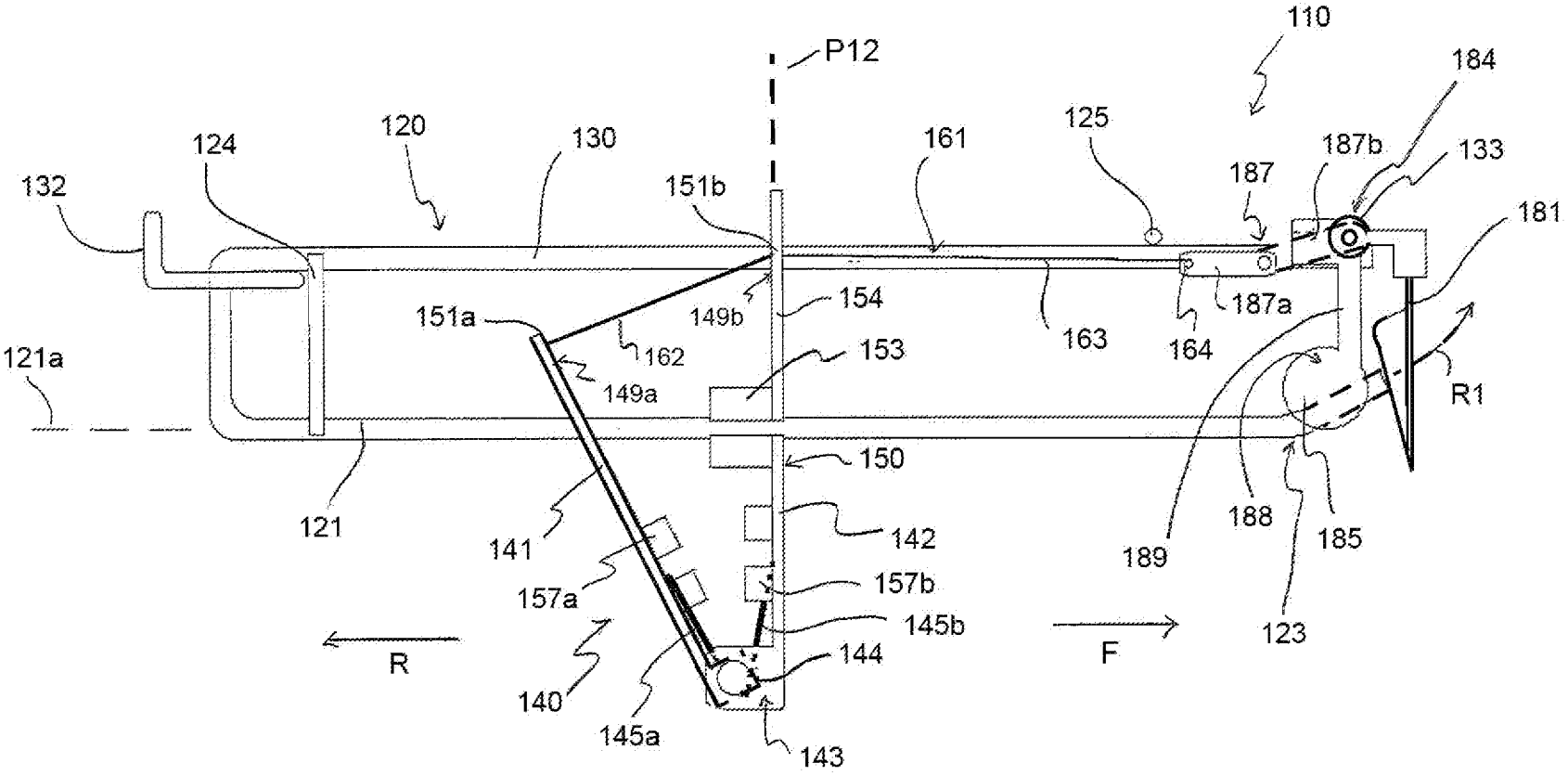
FIG. 15 is a schematic side view of a retail hook device according to a second embodiment.

Referring to FIG. 15 there is shown a second embodiment of a display hook device 110. Display hook device 110 is similar to that of the first embodiment and like features will be referred to using like reference numerals.

A retail hook rail 120 may optionally include a rearward vertical stop bar 124 immediately forward of a holding member 132 to limit the rearward extent of travel of a carriage 140. A horizontal and laterally extending detent 125 may be optionally mounted or welded to the upper surface of an upper rod 130. The detent 125 is intended to limit the extent of frontward travel of the carriage 140.

The carriage 140 comprises a second arm 142 adapted to remain substantially vertical or transverse and upright relative to a lower rod 121 and, for this purpose, comprises an axially aligned tube 153 integrally formed with a moulded panel 154, whereby the tube 154 is of sufficient axial length (relative to the longitudinal axes 121*a* of the lower rod 121) to ensure that the second arm 142 remains in a substantially vertical plane $P_{12}$.

The carriage 140 includes a rearward first arm 141 mounted to a hinge portion 143 cylindrically formed with the panel 154, whereby the first arm 141 is adapted to pivot about the hinge 143 and is biased away from the first arm 141 by a torsion spring 144 co-axially mounted on the hinge 143. The spring arms 145*a,b* are respectively trapped behind abutments 157*a,b* on the first and second arms 141,142. The spring 144 imparts a small amount of torsional force to the first arm 141 and the second arm 142, whereby to apply a tension force to a wire 161 held under tension between a mounting point 151*a* on the first arm 141, through an aperture 151*b* formed in the second arm 142 and extending forwardly along a length 163 to a front terminal end 164.

The front terminal end 164 is anchored to a linkage 187 comprising a pair of link arms 187*a, b*. The linkage arms 187*a,b* are hingedly connected. The front most linkage arm 187*b* is fixedly attached or integrally formed with a crotchet-shaped lever 188. As the lever 188 rotates about a hinge 133, the front most linkage arm 187*b* is forcibly rotated about the hinge bar 133 downwardly, whereby to rotate relative to the intermediate linkage arm 187*a*. A tensional force is applied to the length of wire 161 at a wire section 163 drawing the first arm 141 towards the front. The front display panel 180 loosely rotates about the hinge bar 133 and serves the purpose of providing a display panel for a description of items to be loaded onto the retail hook rail 120. The lever 188 includes one or more rearwardly extending, partly round-shaped, striker members 185 that connect to a lever arm 189. The lever arm 189 joins a hinge 184 (engaging the hinge bar 133) to the striker members 185. The striker members 185 space the lever arm 189 from the front most surface of a front most item (see, for example, item 4*a* in the first embodiment).

As with the first embodiment 10, operation or actuation of the lever 188 serves to apply tension to the wire 161 to draw the carriage 140 frontwardly and the spring bias 144 operates to achieve equilibrium between a looped section 162 between the first and second arms 141, 142 until equilibrium is reached between the spring 144 force and the wire 161 tension. As the carriage 140 is moved frontwardly in the direction F, less of the length of wire 161 is taken up in the section 163 and more length of wire 161 is taken up in the looped section 162, so that the separation between the opposing faces 149*a,b* is widened or increased. As the carriage 140 is moved rearwardly in the direction R, the length of wire 161 extending in the looped section 162 between the opposed faces 149*a, b* is reduced and the frontward length 163 of wire 161 is increased. The looped section 162 combined with the counteracting force of the spring bias 144 enables equilibrium to be achieved between the respective forces, so that a substantially constant frontward force is applied through the front face 150 of the second arm 142, sufficient to urge one or more items 4 forwardly, so that the front most item (eg. 4*a*) locates on or around a bend 123 and the rear most item (eg. 4*b*) abuts against the front face 150.

In FIG. 16-23, there is shown a third embodiment of a display hook device 210 that is similar to the second embodiment display hook device 110, with minor variations in the structure of a carriage 240. The carriage 240 includes first and second arms 241, 242 hinged in a similar manner to the second embodiment whereby the second arm 242 includes a second axial guide 253 to maintain axial alignment of the second arm 242, such that the main panel 250 is maintained substantially normal relative to a lower rod 221. The second axial guide 253 is open sided and provides a recess in the form of an axially aligned slot 255. The slot 255 includes a pair of open sided tubular bores adapted to receive the cylindrical shaped rod 221 in a close fit, whilst permitting the second guide 253 to slide with minimal friction along the rod 221.

Figure 17:
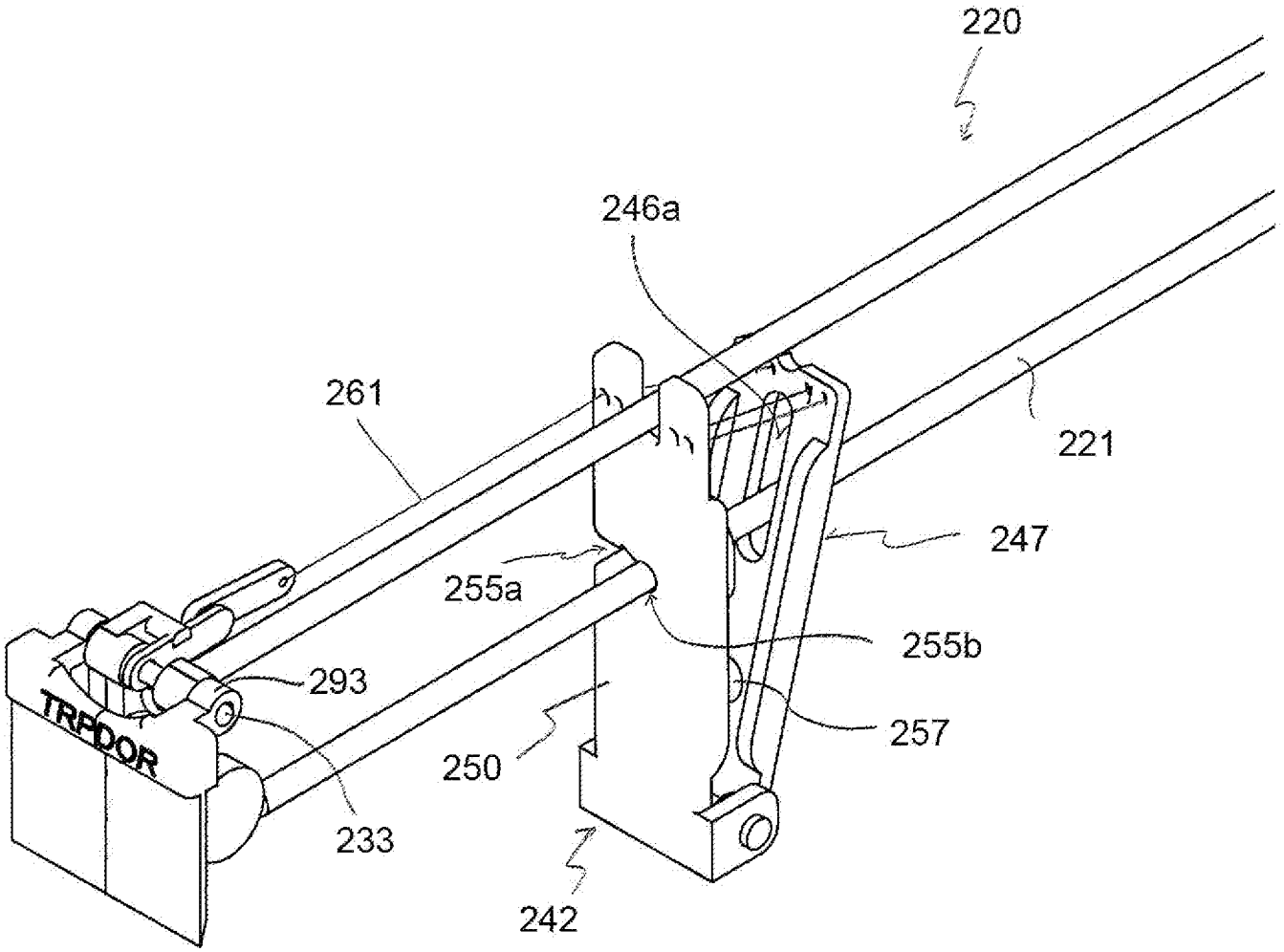
FIG. 17 is an upper perspective view of the embodiment shown in FIG. 16.
Figure 18:
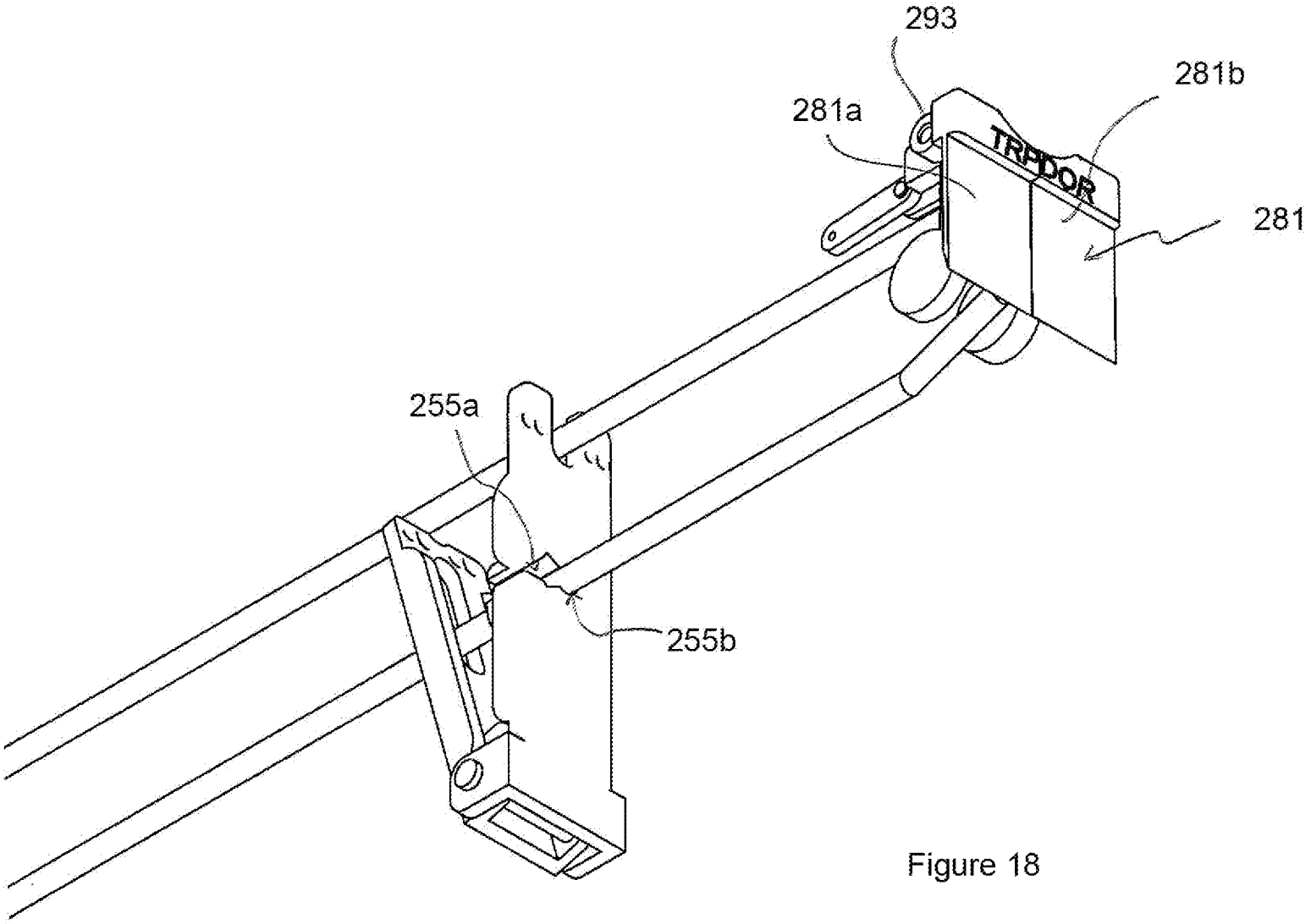
FIG. 18 is a lower perspective view of the embodiment shown in FIG. 16.
Figure 19:
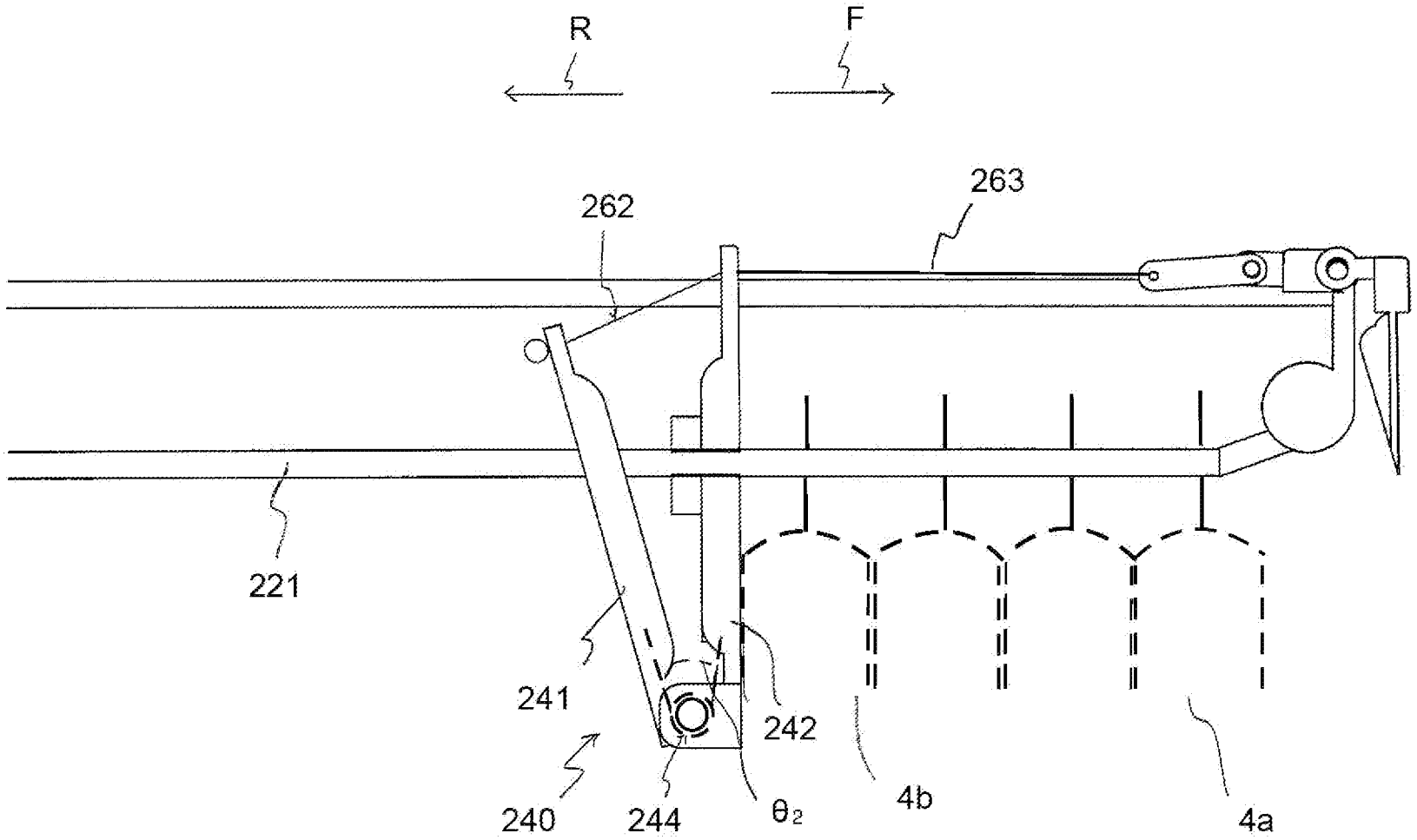
FIG. 19 is a side view of the embodiment shown in FIG. 16 with a carriage located intermediate the length of a hook of the retail hook device.
Figure 20:
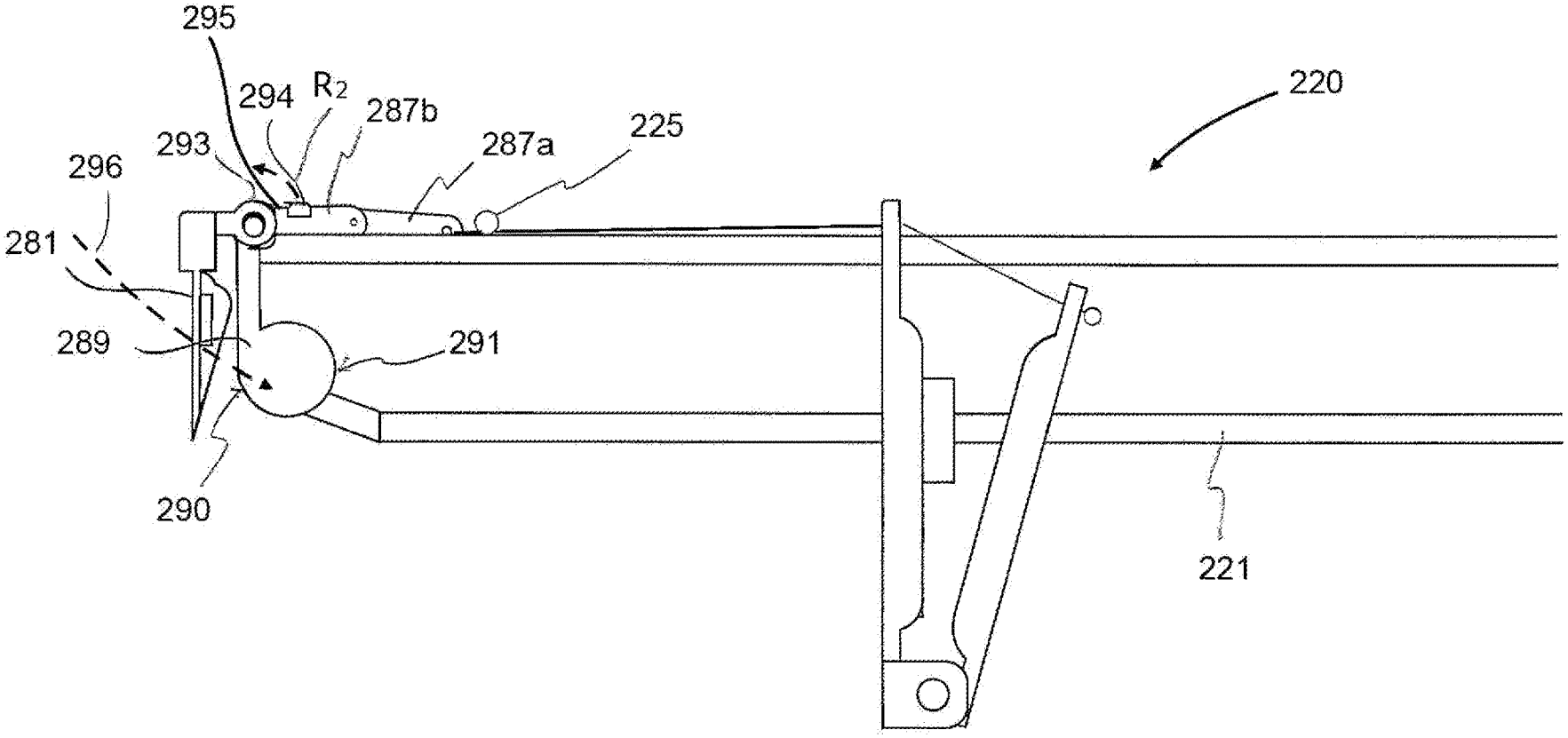
FIG. 20 is a side view of the embodiment shown in FIG. 19.

The recess 255 may include a single open sided bore whereby the guide 253 and the side walls thereof on the open side of the slot 255 are adapted to flex sufficiently to enable the rod 221 to be received therein, but comprising deflectable portions of a tube wall whereby to trap the rod 221 laterally in the slot 255. As seen in FIGS. 17 and 18, the slot 255 includes a first open sided channel 255*a* adapted to initially receive a section of the rod 221. The slot 255 includes a second central open sided channel 255*b* adapted to receive the rod 221 for permanent mounting of the carriage 240 on a retail hook rail 220 of which the lower rod 221 forms a part. The first arm 241 includes a central, substantially vertically aligned, slot 246*a* that permits the first arm 241 to assume a range of angles $theta_2$, being the angle between a planar panel 249 and the planar panel 250, whereby the respective panels 249, 250 respectively lie in the planes $P_{21}$, $P_{22}$.

Figure 21:
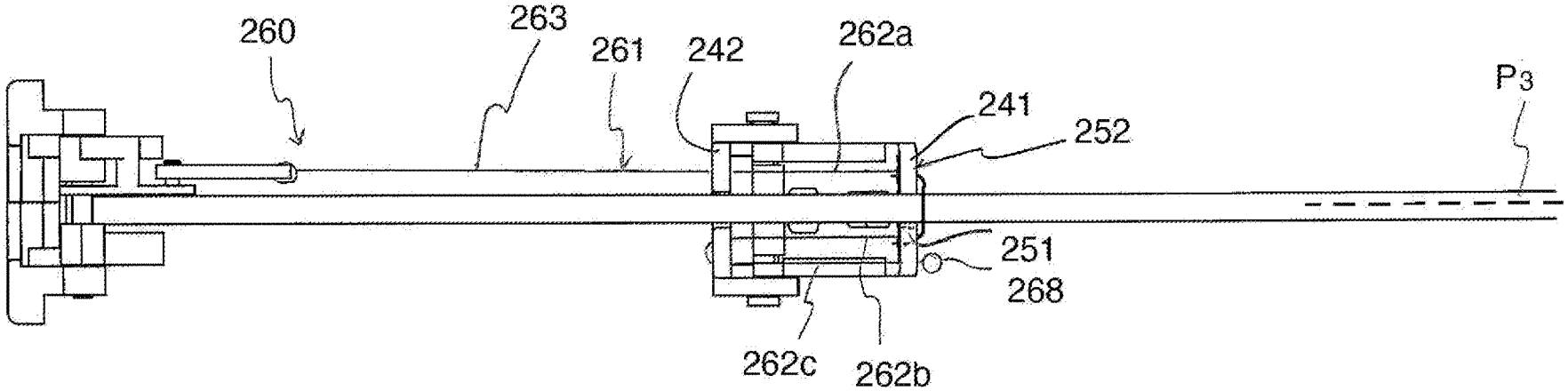
FIG. 21 is a top plan view of the embodiment as represented in FIGS. 17-20.
Figure 22A:
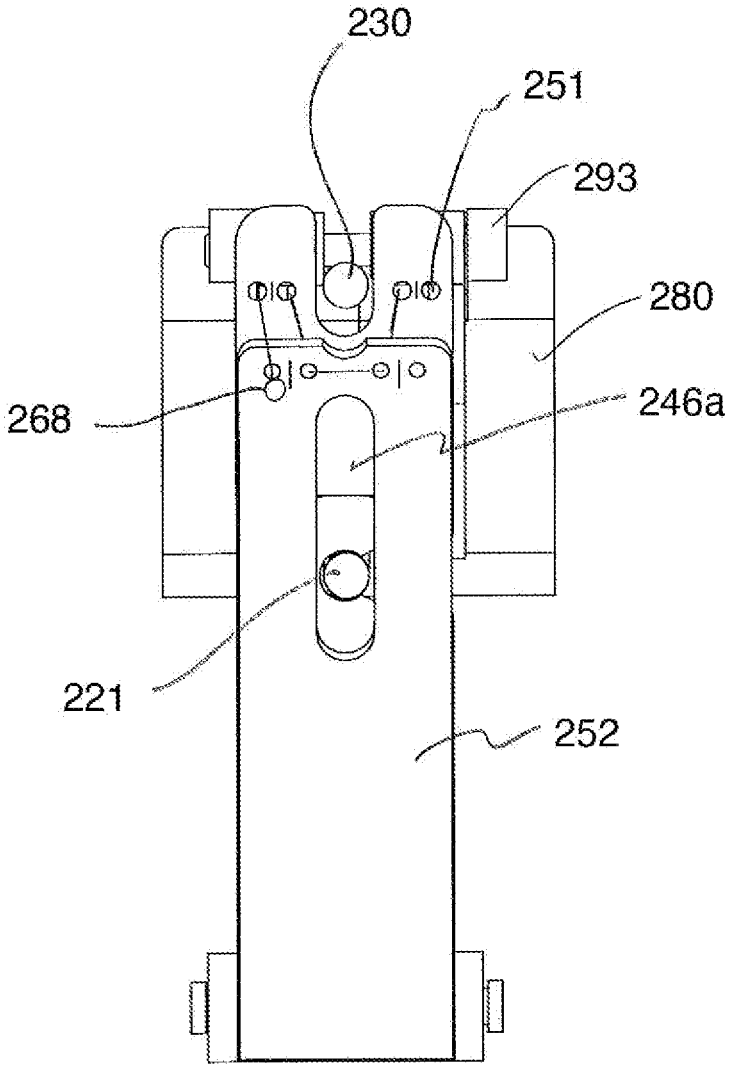
FIG. 22*a* is a rear plan view of the embodiment shown in FIGS. 17-21.
Figure 22B:
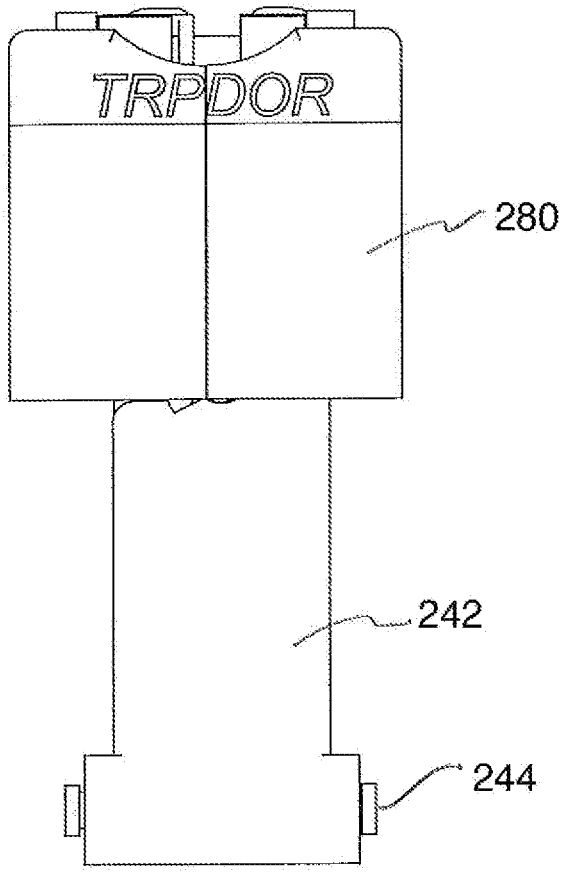
FIG. 22*b* is a front elevation of the embodiment shown in FIGS. 17-21.

The first and second arms 241, 242 include a pair of rigid side flanges 256*a, b* on each side of each panel 249, 250 aligned in a plane parallel to the plane $P_3$ in which the retail hook rail 220 substantially lies with respect to the upper and lower rods 230, 221 (see FIG. 21).

A gathering device 260 is similar to the gathering device 160 of the second embodiment and includes the linkage 287 to which a tensioned wire 261 is attached and extends into a looped formation 262 comprising several passes of the wire 262 between the opposed faces 249*a, b*. The wire 261 is connected to a first linkage 287*a* through a small aperture in the rear end of the linkage 287*a* and by a small anchor or bauble 268 capturing the rearward end of the wire 261 on the rearward face 252 of the first arm 241.

Figure 23:
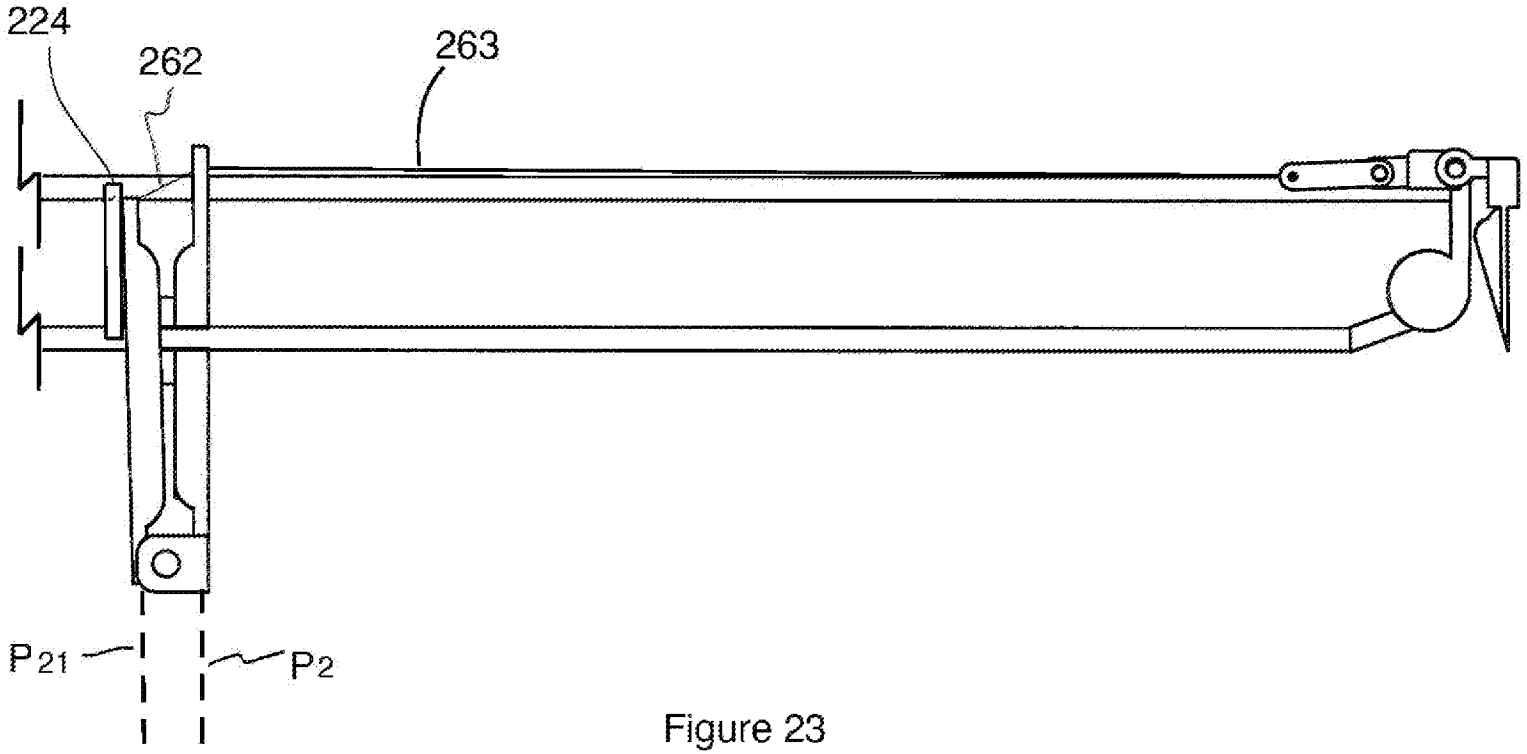
FIG. 23 is a side view of the retail hook device shown in FIG. 16 whereby a gathering device is fully extended and the carriage is positioned rear most.
Figures 24A, 24B, 24C:
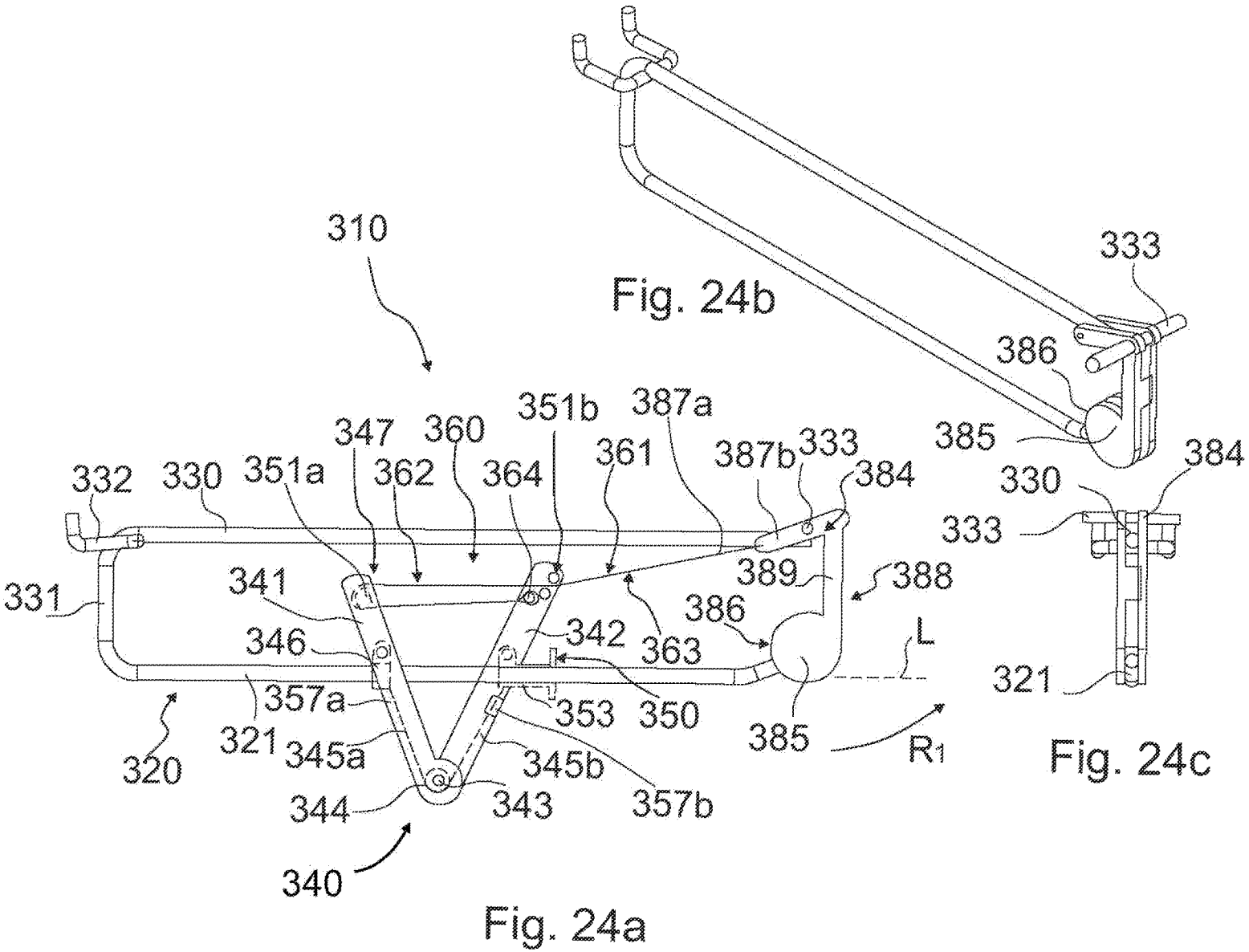
FIG. 24 is side view of a retail display hook device according to a fourth embodiment.

To ensure that the first and second arms 241, 242 of the carriage 240 maintain a minimum spacing relative to each other when the first panel 249 is substantially parallel with the second panel 250, when the carriage 240 is most rearward on the retail hook rail 220 as shown in FIG. 23 by the provision of a pair of stops 257 extending from each of the opposed faces 249*a, b*, as most clearly seen in the equivalent structures 257 in FIG. 15.

Figure 16:
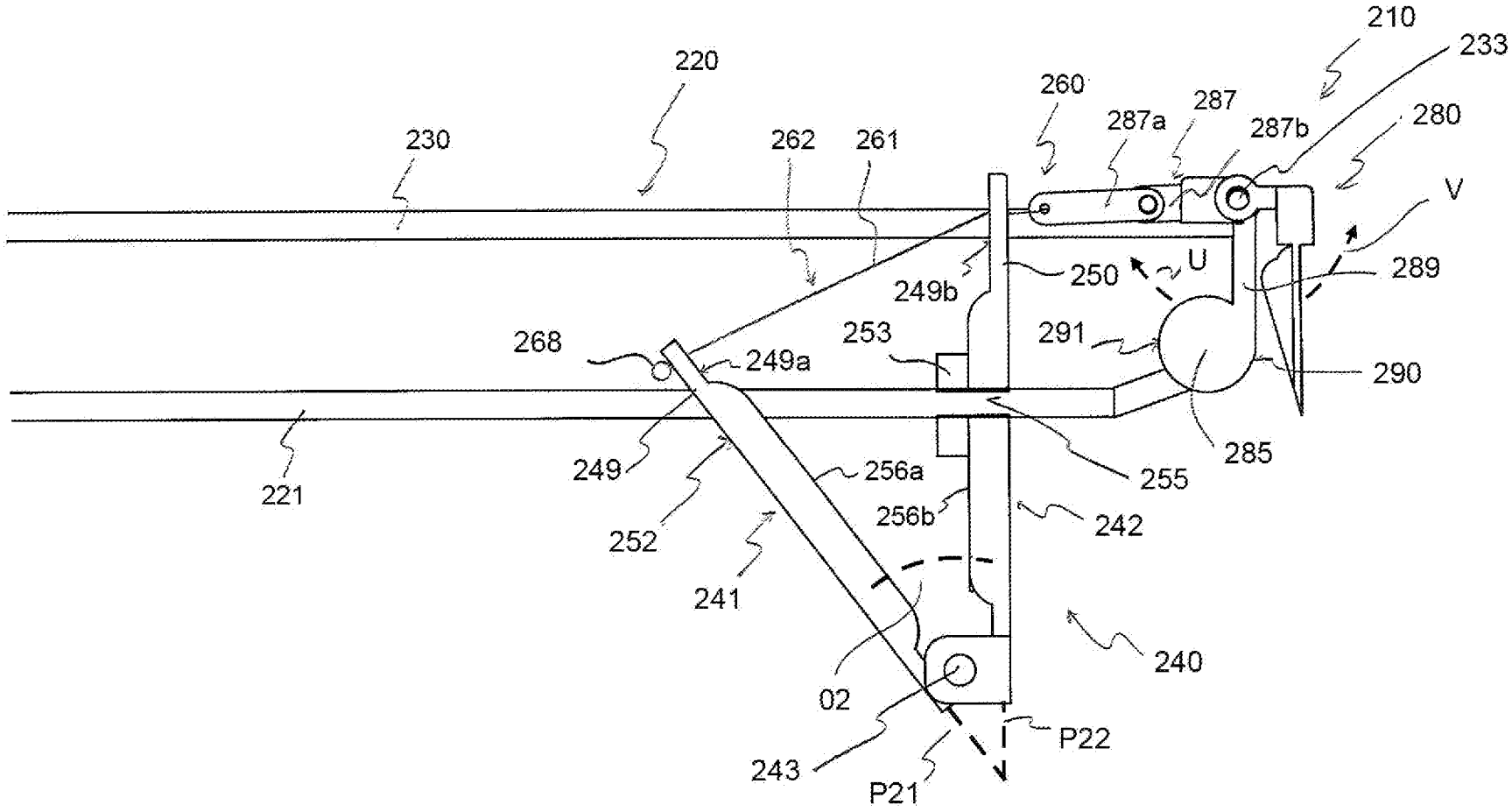
FIG. 16 is side view of a retail display hook device according to a third embodiment.

A display device 280 is louvred and includes a lever arm 289 similar to that of the lever arm 189 of the second embodiment. The striker member 105 may be any one of a number of shapes, preferably oval, or circular shaped as depicted in FIG. 16 and is adapted to allow easy and unhindered deflection when an item 4 to be loaded strikes the smooth and convexly curved smooth front surface 290 whereby the lever arm 289 is rotated movedly and upwardly in the direction U. When an item 4 is removed from the rod 221, the item 4 may be forced against a rearward curved and convex smooth surface 291 whereby to deflect the lever arm 289 frontwardly in a direction V. In each case, the rotation of the lever arm 289 draws the hinge 292 between the first and second linkages 287*a, b* forwardly to apply tension to the wire 261 and correspondingly draw the wire 261 forward, thereby gathering the wire 261 extending in loops 262 between the first and second arms 241, 242 to draw the first arm 241 towards the second arm 242, whereby the carriage 240 is either pushed rearwardly by the force of the operator loading a packaged item 4 or allowed to creep forward on equalization of the balance of tension in the wire 261 through the loops 262 and a spring bias 244 mounted to a hinge 243 connecting the first and second arms 241, 242. Spring arms 245*a,b* are respectively trapped behind abutments 257*a,b* on first and second arms 241,242.

The front display panel 281 comprises a pair of half portions 281*a, b* that comprise sleeves 293 that clip over the free and protruding ends of a lateral hinge 233.

The strength of the torsion spring 244 is calibrated to have sufficient force to urge the first and second arms 241, 242 as far apart as possible within the constraint for the number of items 4 loaded onto the rod 221. The mechanism operates such that the gathering device 260 gathers the maximum amount of wire 262 between the first and second arms 241, 242 which is limited by the minimum length of wire 263 possible as determined by the intervening items 4 loaded on the rod 221. The less items 4 on the rod 221, the more wire 261 is able to be gathered in the loops 262 by the urging and spreading action of the torsion spring 244. The more items 4 loaded on the rod 221, the further back in the carriage 240 is pushed and the smaller the angle theta 2 as wire 261 from the loops 262 is deployed to the linear length 263.

The lever arm 289 includes an upper transverse arm 295 and a stop member 294 extending transfers relative to the second linkage 287*b*. When items 4 are loaded onto the retail hook rail 220, the loosely hinged display panel 281 is first lifted up and flipped out of the way. As the item strikes the front striker surface 290, the lever arm 289 rotates rearwardly and upwardly out of the way to clear a passage 296 onto the lower rod 221 and the transverse arm 295 and stop member 294 rotate upwardly and frontwardly in the direction R2, so that the lever arm 289 is freely deflected and does not constitute an obstruction to the loading of the items 4. However, when items 4 are removed from the lower rod 221 the transverse stop member 294 bears down on the upper surface of the second linkage 287*b* to indirectly apply tension to the wire 261 through the first linkage 287*a*.

Referring to FIG. 21, the gathering device 260 with respect to the wire 261 is shown in which the wire 261 loops 262 include a first pass 26*a* extending from an aperture through the first arm 241 along a first pass 26*a*. The wire 261 is wrapped around the surface 252 and extends through an aperture 251 in the first arm 241 and onto a second pass 262*b* extending back to the second arm 242 and, on return, along a third pass 262*c* whereupon the rearward end of the wire 261 is anchored by a bauble 268. As the reader will appreciate, by increasing the number of fasteners 262 of the wire 261 between the first and second arms 241, 242, the multiplication or gearing effect of the wire 261 may be increased to permit a greater length of reciprocal travel of the carriage 240 along the retail hook rail 220.

Another embodiment of the invention is shown in FIGS. 24-27 in the form of a display hook device 310 being another variation on the second embodiment. A lever 388 similar to the lever 188 is hingedly mounted to a hinge bar 333 and is adapted to pivot as a frontmost item 4*a* strikes a rear facing striker surface 386 and is removed off a front hook portion 322 of a lower rod 321 of a retail hook rail 320.

Outward rotation of the lever 388 in the direction $R_1$ will cause a front linkage 387*b* to correspondingly dip or rotate downwardly. An intermediate link or connection 387*a* connects the front linkage 387*b* to a high-tensile tether or web 361, comprising a flat, ribbon-like length of material that is wider in plan than in side view. The front length of web 361 transitions through guides 351*b* that are in the form of a series of stubs extending from an inner wall of the second arm 342. The stubs 351*b* are capped by a second cover 358*b* (not shown in FIG. 24 to demonstrate the guide's 351*b* feed arrangement clearly) so that the transition length of web 361 passing through the guides 351*b* is trapped between the inner wall and the guide's second cover 358*b*.

The web 361 loops once with a first and a second pass through the zone 362 extending between the first and second arms 341,342. An intermediate portion (shown in broken lines) of the length of web 361 in the zone 362 looping around a lateral pillar 351*a* (also shown in broken lines as it is obscured by the beam forming the first arm 341) extending internally from an inner wall of the first arm 341. The pillar 351*a* is also capped by a first cover 358*b* (not shown in FIG. 24) that traps an intermediate portion of the length of web 361 as it transitions between the front zone 363 and the loop zone 362.

The end portion of the web 361 of the single loop returning from the pillar 351*a* terminates at an inwardly extending pillar 364 about which the end portion is secured and trapped by the second cover.

The first and second arms 341,342 form part of a carriage 360 that is mounted only to a single rod of the retail hook rail 320 being the lower rod 321. This is by virtue of the a first axial guide 346 and a second axial guide 353 for the second arm 342, each of the first and second axial guides 346,353 being hingedly attached to the first and second arms 341 so that the first and second arms 341,342 can rotate about a mutual hinge 343 located under the retail hook rail 320 or the lower rod 321, whilst remaining slidingly engaged to the retail hook rail 320. The first and second axial guides 346,353 have sufficient axial length to remain axially aligned with the lower rod 321. The second arm's 342 second axial guide 353 provides a front wall in the form of a barrier 350 that is adapted to abut the rearmost item (eg. 4*b*).

A torsion spring 344 wound about the hinge 343 urges the upper ends 347 of the first and second arms 341,342 apart. Spring arms 345*a,b* are respectively trapped behind abutments 357*a,b* on first and second arms 341,342. The first and second axial guides 346,353 keep the carriage 340 stably mounted on the retail hook rail 320. As the lever 388 is rotated in direction $R_1$ the intermediate portion of web 361 slides forwardly through the guides 351*b* and draws the upper portion 347 of the first arm 341 forward. With the outward bias action of the torsion spring 344, as the first arm 341 advances forward along the retail hook rail 320 and the torsion spring 344 correspondingly urges the second arm 342 forward also. The more intermediate length of the web 361 taken up in loop zone 362 relative to forward zone 363, the wider the first and second arms 341,342 are spread relative to one another. The more length of web 361 fed forward of the second arm 342 in the forward zone 363, the less intermediate portion of web 361 is located in the loop zone 362, so that the first and second arms 341,342 are drawn closer together the more rearward they travel along the retail hook rail 320.

In the inventive arrangement, the carriage 40,340 is a self-locating mechanism that automatically urges the remaining items 4 on the retail hook rail 20,320 to be pushed as forward as possible on the retail hook rail 20,320. This assists a retail store in providing good presentation of wares for sale with minimum work hours devoted to maintaining the items 4 on the display hook device 310. The striker member 185,385 optimally spaces the frontmost item 4*a* rearwardly from the lever arm 189, 389 to ensure adequate deflection of the lever 188,388 and extent of rotation $R_1$. The first arm 341 may be predominantly plate-shaped having a larger width in a direction parallel to the longitudinal axis L than depth transverse to the axis L. This may assist the beam of the first arm 341 in resisting mechanical fatigue or failure as a result of the torsional forces applied by the torsion spring 344 and gathering device 360. the second arm 342 may be similarly shaped. The first and second arms 341,342 may form a scissor arrangement that straddles the retail hook rail 320, and in particular, the lower rod 321. The first arm 341 may extend laterally relative to the retail hook rail 320 on a first side. The second arm 342 may extend laterally relative to the retail hook rail 320 on a second side opposed to the first side.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

Where the word "for" is used to qualify a use or application of an object term, the word "for" is only limiting in the sense that the device or component should be "suitable for" that use or application.

The meaning of descriptive, precise or absolute terms such as "flexed", "normal", "parallel", "horizontal", "vertical" or "fully" includes the preceding qualifier "substantially or almost", unless the context or contrary is expressly indicated.

In the present specification, object terms such as "apparatus", "means", "device" and "member", or similar terms, may refer to singular or plural items and are terms intended to refer to a set of properties, functions or characteristics performed by one or more items or components having one or more parts. It is envisaged that where the object term is described as being a unitary object, then a functionally equivalent object having multiple components is considered to fall within the scope of the object term, and similarly, where the object term is described as having multiple components, a functionally equivalent but unitary object is also considered to fall within the scope of the object term, unless the contrary is expressly stated or the context requires otherwise. Orientational terms used in the specification and claims such as vertical, horizontal, top, bottom, upper and lower are to be interpreted as relational and are based on the premise that the component, item, article, apparatus, device or instrument will usually be considered in a particular orientation, typically with the upper rod 30 and the hinge bracket 84 uppermost.

It will be appreciated by those skilled in the art that many modifications and variations may be made to the methods of the invention described herein without departing from the spirit and scope of the invention. The features and components of each of the embodiments of the invention described in the detailed description and/or depicted in the accompanying drawings may be interchangeable as required, with regard to functional equivalency and compatibility. A feature or component described with reference to one but not all embodiments, if functionally and dimensionally compatible as an addition with another embodiment herein described, or substitutable with a corresponding feature or component of that other embodiment in relation to which it has not been expressly described, should be read as a potential addition or substitution to that other embodiment and as being within the scope of the invention. Furthermore, in considering a feature or component that is described in relation a particular embodiment but may be omitted from the embodiment without losing the functionality characterising the invention and without departing from the scope of the invention, unless the context and expressions used in describing the embodiment imputes that the feature or component is essential to the invention as broadly described, the omittable feature or component may be read as not being included in the embodiment.

The invention claimed is:

1. A retail hook device comprising:

a carriage mounted to a retail hook rail adapted to be cantileveredly supported by a support structure, the carriage comprising a first arm adapted to slide along the retail hook rail, and be hingedly attached by a mutual hinge to a second arm that is adapted to reciprocate along the retail hook rail, wherein:

the first arm and the second arm are biased to pivot apart from each other, such that the first arm tends to assume an inclined position relative to the retail hook rail and the first arm is adapted to be drawn towards an upper portion of the second arm by a gathering device extending between the respective first and second arms, and the gathering device is flexible and extends forward beyond the second arm to a lever mounted to the front of the retail hook rail.

2. The retail hook device of claim 1, wherein the second arm is mounted to the retail hook rail by an axial guide of the second arm.

3. The retail hook device of claim 2, wherein the axial guide of the second arm is hingedly attached by a hinge of the second arm to a beam of the second arm intermediate the length of the second arm.

4. The retail hook device of claim 3, wherein the axial guide of the second arm includes a broad barrier extending forward of the beam and adapted to urge a rearmost item mounted on the retail hook rail frontward.

5. The retail hook device of claim 1, wherein the first arm is hingedly attached by a hinge of the first arm to the retail hook rail by an axial guide of the first arm and is laterally spaced from a longitudinal axis of the retail hook rail a first fixed distance.

6. The retail hook device of claim 5, wherein the hinge of the second arm is laterally spaced from the longitudinal axis a second fixed distance.

7. The retail hook device of claim 1, wherein the carriage includes a scissor mechanism in which the first and second arms are adapted to incrementally advance along the retail hook rail in response to the rotation of the lever to which the gathering device is attached.

8. The retail hook device of claim 7, wherein the gathering device is linked to the lever by a pair of linkages, in respect of which a front linkage is inclined downwardly and rearwardly relative to a lever arm depending downwardly from a hinge connection between the lever and the retail hook rail.

9. The retail hook device of claim 8, wherein the lever arm terminates at a lower portion in a rearwardly extending striker member.

10. The retail hook device of claim 9, wherein the lever is crotchet-shaped and the striker member presents a curved ramp or cam surface to a frontmost item.

11. The retail hook device of claim 2, wherein the first arm is hingedly attached by a hinge of the first arm to the retail hook rail by an axial guide of the first arm and is laterally spaced from a longitudinal axis of the retail hook rail a first fixed distance.

12. The retail hook device of claim 3, wherein the first arm is hingedly attached by a hinge of the first arm to the retail hook rail by an axial guide of the first arm and is laterally spaced from a longitudinal axis of the retail hook rail a first fixed distance.

13. The retail hook device of claim 4, wherein the first arm is hingedly attached by a hinge of the first arm to the retail hook rail by an axial guide of the first arm and is laterally spaced from a longitudinal axis of the retail hook rail a first fixed distance.

14. The retail hook device of claim 2, wherein the carriage includes a scissor mechanism in which the first and second arms are adapted to incrementally advance along the retail hook rail in response to the rotation of the lever to which the gathering device is attached.

15. The retail hook device of claim 3, wherein the carriage includes a scissor mechanism in which the first and second arms are adapted to incrementally advance along the retail hook rail in response to the rotation of the lever to which the gathering device is attached.

16. The retail hook device of claim 4, wherein the carriage includes a scissor mechanism in which the first and second arms are adapted to incrementally advance along the retail hook rail in response to the rotation of the lever to which the gathering device is attached.

17. The retail hook device of claim 5, wherein the carriage includes a scissor mechanism in which the first and second arms are adapted to incrementally advance along the retail hook rail in response to the rotation of the lever to which the gathering device is attached.

18. The retail hook device of claim 6, wherein the carriage includes a scissor mechanism in which the first and second arms are adapted to incrementally advance along the retail hook rail in response to the rotation of the lever to which the gathering device is attached.

19. The retail hook device of claim 1, wherein the gathering device is a flexible length of high tensile material in the form of a cord that is looped between the first arm and the second arm to provide at least two lengths of cord extending between the first arm and the second arm.

* * * * *